US007757532B2

(12) United States Patent
Mizukawa

(10) Patent No.: US 7,757,532 B2
(45) Date of Patent: Jul. 20, 2010

(54) METHOD AND APPARATUS FOR BENDING A BLADE MEMBER

(76) Inventor: Suehiro Mizukawa, 4-25, Torikainishi 5-chome, Settsu-shi, Osaka (JP)

( * ) Notice: Subject to any disclaimer, the term of this patent is extended or adjusted under 35 U.S.C. 154(b) by 474 days.

(21) Appl. No.: 11/802,621

(22) Filed: May 24, 2007

(65) Prior Publication Data

US 2007/0283737 A1 Dec. 13, 2007

(30) Foreign Application Priority Data

May 31, 2006 (JP) ..... 2006-151194

(51) Int. Cl.
*B21D 11/00* (2006.01)
*B21D 9/05* (2006.01)
*B21D 31/00* (2006.01)

(52) U.S. Cl. ..... 72/306; 72/307; 72/387

(58) Field of Classification Search ..... 72/307, 72/306, 310, 214, 217, 387, 388, 319, 294
See application file for complete search history.

(56) References Cited

U.S. PATENT DOCUMENTS 5,507,168 A * 4/1996 Mizukawa et al. ..... 72/387
5,771,725 A * 6/1998 Mizukawa ..... 72/17.3

FOREIGN PATENT DOCUMENTS

JP 2003001352 * 7/2003
JP 2004 141959 5/2004

* cited by examiner

*Primary Examiner*—Dana Ross
*Assistant Examiner*—Mohammad Yusuf
(74) *Attorney, Agent, or Firm*—Bacon & Thoms, PLLC

(57) ABSTRACT

In the width-direction bending step for the blade member, the blade member is clamped by a pair of rotary press claws 13, 14 from both sides in the thickness direction to be compressed in the thickness direction, whereby the compressed portion is extended in the longitudinal direction of the blade member and the blade member is bent in the width direction. In the thickness-direction bending step for the blade member, a working die portion comprises: a thickness-direction bending shaft 31; and a thickness-direction bending cylinder 32 which is fitted in a turning paired state onto the thickness-direction bending shaft. The thickness-direction bending shaft 31 and the thickness-direction bending cylinder 32 are relatively rotated, whereby the blade member is bent in the thickness direction.

22 Claims, 40 Drawing Sheets

Fig. 2 4 A
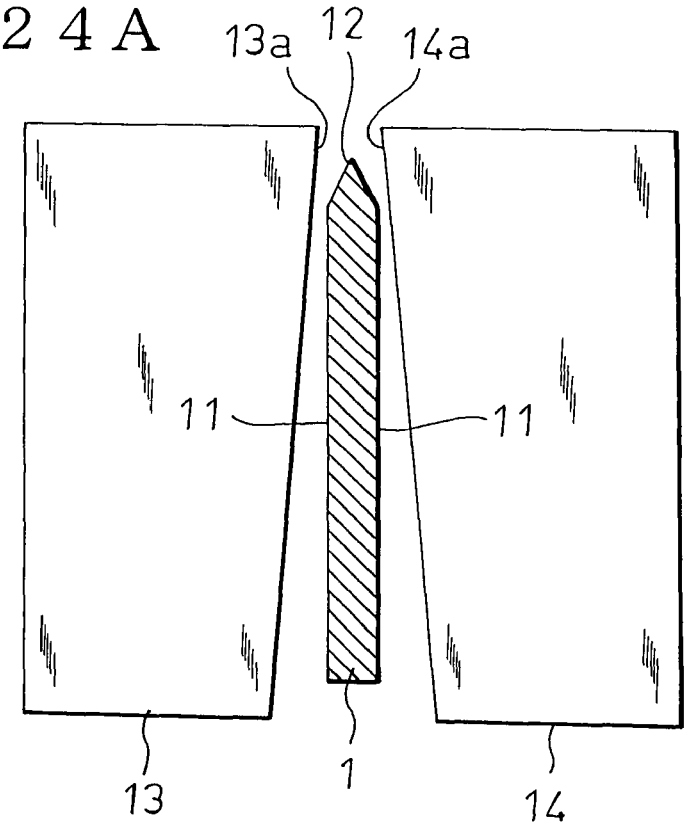
Fig. 2 4 B
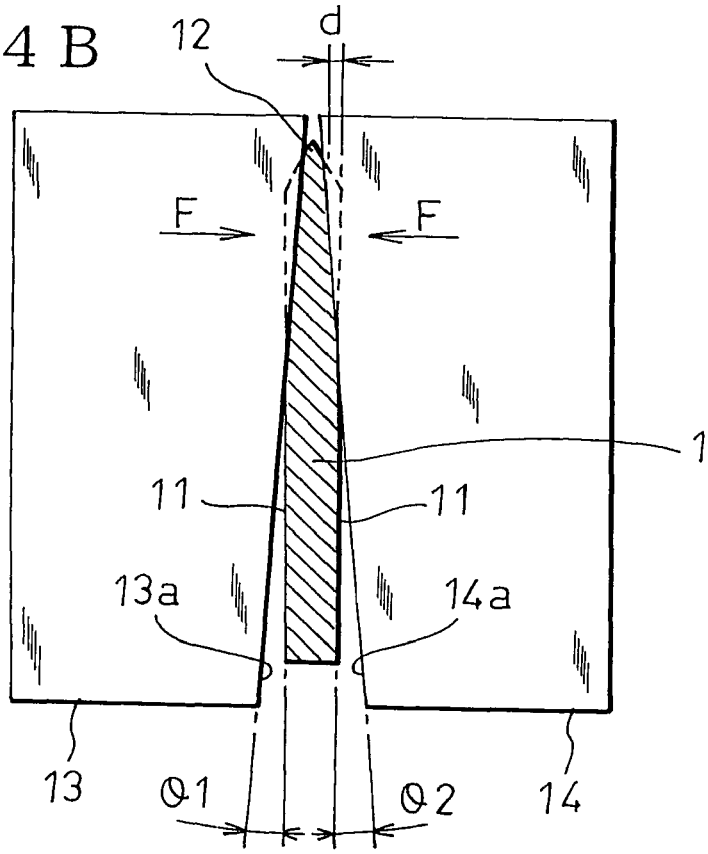

Fig. 2 5 A
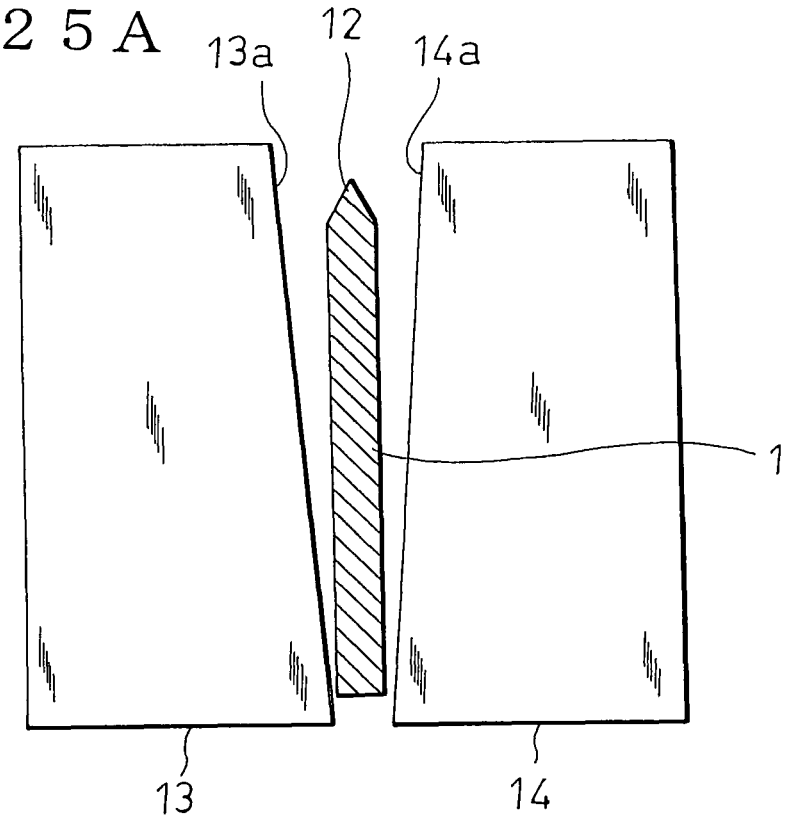
Fig. 2 5 B
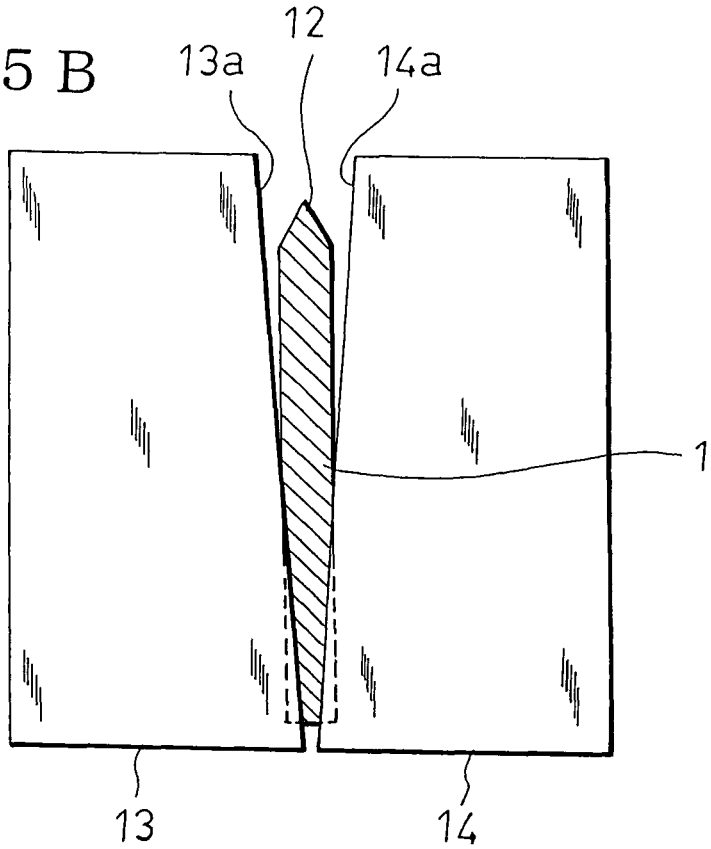

Fig. 2 9 A
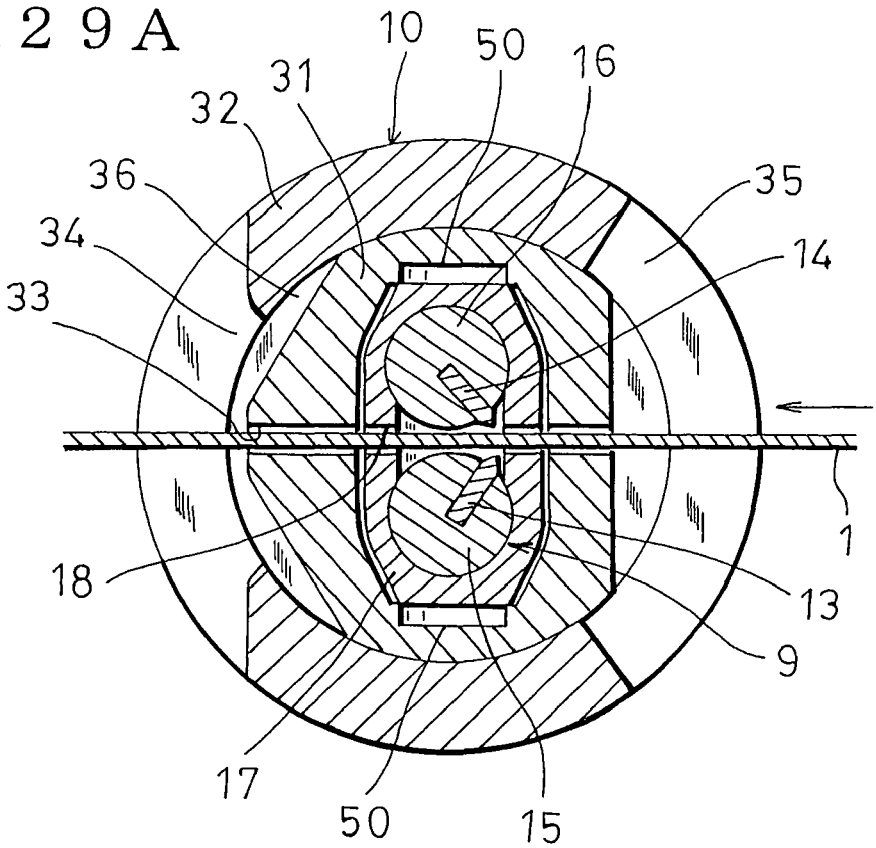
Fig. 2 9 B
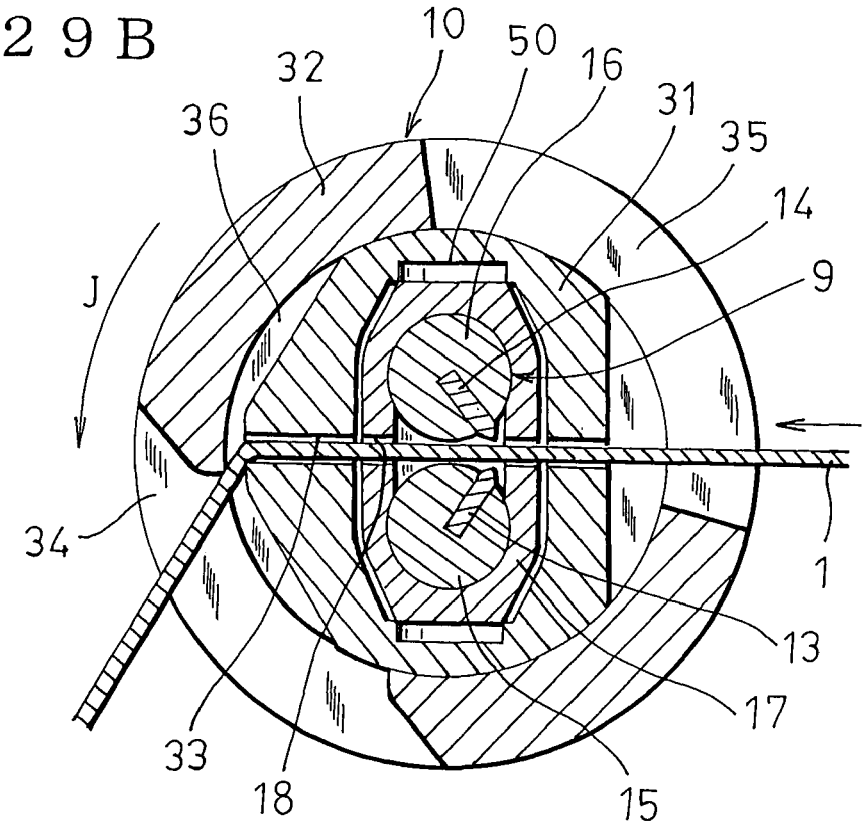

METHOD AND APPARATUS FOR BENDING A BLADE MEMBER

BACKGROUND OF THE INVENTION

1. Field of the Invention

The present invention relates to a method and apparatus for bending a blade member in which a process of bending a strip-like blade member in the width direction, and that of bending the blade member in the thickness direction can be continuously performed.

2. Explanation of Related Art

For example, there is a case where, as shown in principle in FIGS. 36 and 37, notches or perforations are formed in a work W such as paperboard by using a rotary die 100 to which a blade member 1 is attached. In this case, the rotary die 100 is used while being combined with an anvil 200 serving as a receiving roller. In the blade member 1 attached to the rotary die 100, a blade edge 12 which is disposed in one end edge in the width direction is projected from the outer peripheral face of the rotary die 100, and the blade edge 12 is curved into a shape which is parallel to the outer peripheral face of the rotary die 100. The work W is fed as indicated by the arrow between the rotary die 100 and the anvil 200 while rotating the die and the anvil, notches or perforations having a shape corresponding to that of the blade edge 12 of the blade member 1 are formed in the work W. As the anvil 200, either of a member which is made of iron, and in which the surface is hard, and that which is made of rubber or the like, and in which the surface is soft is suitably used.

FIGS. 38 to 40 show an example of a bending procedure for obtaining the blade member 1 attached to the rotary die 100 shown in FIG. 36. FIG. 38 shows a state where the blade member 1 is bent in the thickness direction to be formed into a substantially rectangular shape in a plan view. In this state, the whole blade edge 12 is in a virtual horizontal plane. FIG. 39 shows a state where one side of the rectangular blade member 1 of FIG. 38 is bent in the range from one end portion to an intermediate portion, in the width direction of the blade member 1. As seen from the figure, in this stage, the portion on which the bending work in the width direction is performed is changed into a curved shape in which the shape in a side view of the blade member 1 is swollen, i.e., a curved shape which extends along the outer peripheral face of the rotary die 100. FIG. 40 shows the blade member 1 which is obtained by performing the bending work on one side of the rectangular blade member 1 and the opposed side.

For example, a blade member bending method in which the blade member 1 having a blade edge in one end edge in the width direction is bent in the width direction has been proposed by the assignee of the present invention (see Japanese Patent Application Laying-Open No. 2004-141959). The proposed method includes a compressing/extending step in which a portion in the vicinity of the blade edge is clamped by roller dies from the both sides to compress the portion in the thickness direction, thereby extending the compressed portion in the longitudinal direction. In the compressing/extending step, the dies are rotated and the compressed portion is continuously displaced, whereby the blade member is bent in the width direction.

In the method of bending the blade member 1 in the width direction, however, a blade member which is previously bent in the thickness direction into a desired shape by another thickness-direction bending machine is obtained, and the blade member is bent in the width direction. In this way, the thickness-direction bending process and the width-direction bending process are performed by respective machines in separate places. Therefore, the production efficiency is poor, and the production cost is high.

In the case where a blade member which is previously bent in the thickness direction, there is a problem in that, even when blade members of various curvatures are prepared, a case where a blade member having an adequate curvature matched to the width-direction bending process cannot be found often occurs. In a system of bending a blade member in which the blade member is previously bent in the thickness direction and then bent in the width direction to obtain a complete blade member product, it is difficult to obtain a blade member product in which the bending in the thickness direction accurately coincides with the curvature of the blade member bent in the width direction, or namely it is difficult to obtain a blade member product which has a complex curved shape.

SUMMARY OF THE INVENTION

The invention has been conducted in order to solve the problems. It is an object of the invention to provide a method and apparatus for bending a blade member in which a process of bending a blade member in the width direction, and that of bending the blade member in the thickness direction can be continuously performed, whereby the production efficiency can be improved.

It is another object of the invention to provide a method and apparatus for bending a blade member in which a process of bending a blade member in the width direction, and that of bending the blade member in the thickness direction can be continuously performed, and the whole bending apparatus can be compacted and miniaturized.

It is a further object of the invention to provide a method and apparatus for bending a blade member in which bending in the thickness direction can be performed in accordance with the curvature of a blade member bent in the width direction, whereby a blade member product having a fine and complex shape can be obtained highly accurately.

The blade member bending method of the invention will be described with reference to the reference numerals used FIGS. 1 to 23, in order to facilitate the understanding of the invention. In a method of bending a blade member in which a strip-like blade member 1 having an blade edge 12 in one end edge in the width direction is intermittently fed to a working die portion 5, and a bending process is performed by the working die portion 5 during stoppage of the feeding process, the bending process by the working die portion 5 includes: a width-direction bending step of bending the blade member 1 in the width direction; and a thickness-direction bending step of, after the bending process, bending the blade member in the thickness direction. In the width-direction bending step for the blade member, the blade member 1 is clamped by a pair of rotary press claws 13, 14 disposed in the working die portion 5, from both sides in the thickness direction to be compressed in the thickness direction, whereby the compressed portion is extended in the longitudinal direction of the blade member and the blade member is bent in the width direction. In the thickness-direction bending step for the blade member 1, the working die portion 5 comprises: a thickness-direction bending shaft 31; and a thickness-direction bending cylinder 32 which is fitted in a turning paired state onto the thickness-direction bending shaft, a blade member passing hole 33 which allows the blade member 1 to pass therethrough is penetratingly formed in the thickness-direction bending shaft 31 in a direction perpendicular to an axis of the thickness-direction bending shaft, first and second openings 34, 35 which are opposed respectively to outlet and inlet opening ends of the blade member passing hole 33 are formed in the thickness-direction bending cylinder 32, a predetermined gap 36 is disposed between an outer peripheral face of an outlet forming portion of the blade member passing hole 33 in the thickness-direction bending shaft 31, and an inner peripheral face of a first-opening forming portion in the thickness-direction bending cylinder 32, and the thickness-direction bending shaft 31 and the thickness-direction bending cylinder 32 are relatively rotated, whereby the blade member 1 which is passed from the blade member passing hole 33 to the first opening 34 via the second opening 35 is bent in the thickness direction.

According to the thus configured blade member bending method, after the blade member is bent in the width direction, the bending process in the thickness direction can be succeedingly performed, and therefore the production efficiency can be remarkably improved.

In the blade member bending method of the invention, the width-direction bending step for the blade member may be performed so that a compression amount in the compressed portion of the blade member 1 is gradually increased as advancing toward one end edge in the width direction of the blade member 1. In the specification, the compression amount means the amount of reduction of the thickness which occurs in the case where the blade member 1 is compressed in the thickness direction. According to the configuration, the extension length of a portion of the blade member 1 due to the compression is longer as the portion is closer to the one end edge in the width direction of the blade member 1, and is shorter as the portion is remoter from the one end edge in the width direction. Therefore, the compressed portion can be worked into a curved shape in which the one end edge in the width direction of the blade member 1 is swollen in the width direction as shown in FIG. 26.

In the blade member bending method of the invention, the width-direction bending step for the blade member 1 may be performed so that a compression amount in the compressed portion of the blade member 1 is gradually increased as advancing toward another end edge in the width direction of the blade member 1. According to the configuration, the extension length of a portion of the blade member 1 due to the compression is longer as the portion is closer to the other end edge in the width direction of the blade member 1, and is shorter as the portion is remoter from the other end edge in the width direction. Therefore, the compressed portion can be worked into a curved shape in which the other end edge in the width direction of the blade member 1 is swollen in the width direction as shown in FIG. 28.

In the blade member bending method of the invention, the width-direction bending step for the blade member 1 may be performed by using the rotary press claws 13, 14 which have a V-like section shape, and which comprise tip end edges 13*a*, 14*a* extending along the width direction of the blade member 1, respectively. In this case, the pair of rotary press claws 13, 14 may be placed on both sides across the blade member 1 in a manner that the rotary press claws are relatively rotatable in opposite directions, and the rotary press claws 13, 14 are caused to approach each other by relative rotation, thereby performing the width-direction bending process. According to the configuration, the blade member 1 can be bent in the thickness direction while a pressing force due to the tip end edges 13*a*, 14*a* of the rotary press claws 13, 14 is concentrated to the blade member 1, and the blade member 1 is efficiently extended.

In the blade member bending method of the invention, the width-direction bending process may be performed by using the rotary press claws 13, 14 in which the tip end edges 13*a*, 14*a* are tilted with respect to side faces 11, 11 of the blade member 1 that are opposed to the tip end edges. According to the configuration, in the width-direction bending process, the compression amount of the blade member 1 is gradually increased or decreased as advancing toward one end edge in the width direction of the blade member 1, simply by pressing the rotary press claws 13, 14 against the blade member 1.

In the blade member bending method of the invention, the width-direction bending process may be performed by a configuration where the pair of rotary press claws 13, 14 are attached to a pair of rotary press driving shaft 15 and rotary press driven shaft 16 which are opposed in a vertical posture to each other on both sides across the blade member 1, in a manner that the rotary press claws are relatively rotatable in opposite directions, so that tip end edges 13*a*, 14*a* of the claws are projected to outsides of the shafts, respectively, and the rotary press driving shaft 15 and the rotary press driven shaft 16 are relatively rotated to cause the rotary press claws 13, 14 to approach each other. According to the configuration, in a state where the pair of rotary press claws 13, 14 are held by the rotary press driving shaft 15 and the rotary press driven shaft 16, the width-direction bending process can be performed stably and surely in accordance with relative rotation of the driving and driven shafts.

In the blade member bending method of the invention, the thickness-direction bending process may be performed by a configuration where the thickness-direction bending shaft 31 is formed into a cylindrical shape and fixed, the pair of rotary press driving shaft 15 and rotary press driven shaft 16 are housed in the thickness-direction bending shaft 31, a rotary press cylinder 17 having blade member passing holes 18, 18 is inserted in a manner that the blade member passing holes 18, 18 communicate with the blade member passing hole 33 of the thickness-direction bending shaft 31, and the thickness-direction bending cylinder 32 which is fitted in a turning paired state onto the thickness-direction bending shaft 31 is rotated. According to the configuration, in a state where the thickness-direction bending shaft 31, the rotary press driving shaft 15, the rotary press driven shaft 16, the thickness-direction bending cylinder 32 are compactly housed, the thickness-direction bending process can be performed immediately after the width-direction bending process.

In the blade member bending method of the invention, the thickness-direction bending process may be performed by tilting the thickness-direction bending shaft 31 and the thickness-direction bending cylinder 32 with respect to the blade member 1 so as to coincide with a curvature of the blade member which has been bent in the width direction. According to the configuration, a blade member product having a complex curved face shape can be obtained highly accurately.

The blade member bending apparatus of the invention will be described with reference to the reference numerals used FIGS. 1 to 23, in order to facilitate the understanding of the invention. In an apparatus for bending a blade member in which a strip-like blade member 1 having an blade edge 12 in one end edge in the width direction is intermittently fed to a working die portion 5, and a bending process is performed by the working die portion 5 during stoppage of the feeding process, the working die portion 5 comprises: a width-direction bending die portion 9 which bends the blade member 1 in the width direction; and a thickness-direction bending die portion 10 which, after the width-direction bending process, bends the blade member in the thickness direction. The width-direction bending die portion 9 comprises a pair of rotary press claws 13, 14 which are placed on both sides across the blade member 1 in a manner that the rotary press claws are relatively rotatable in opposite directions, and is configured so that the rotary press claws 13, 14 are provided with tip end edges 13*a*, 14*a* extending along the width direction of the blade member 1, and the rotary press claws 13, 14 are relatively rotated in opposite directions to approach each other to compress the blade member 1 between the tip end edges 13*a*, 14*a* from both sides of the thickness direction to compress the blade member 1 in the thickness direction, whereby the compressed portion is extended in a longitudinal direction of the blade member and the blade member is bent in the width direction. The thickness-direction bending die portion 10 is configured by: a thickness-direction bending shaft 31; and a thickness-direction bending cylinder 32 which is fitted in a turning paired state onto the thickness-direction bending shaft, a blade member passing hole 33 which allows the blade member to pass therethrough is penetratingly formed in the thickness-direction bending shaft 31 in a direction perpendicular to an axis of the thickness-direction bending shaft, first and second openings 34, 35 which are opposed respectively to outlet and inlet opening ends of the blade member passing hole 33 are formed in the thickness-direction bending cylinder 32, a predetermined gap 36 is disposed between an outer peripheral face of an outlet forming portion of the blade member passing hole 33 in the thickness-direction bending shaft 31, and an inner peripheral face of a first-opening forming portion in the thickness-direction bending cylinder 32, and the thickness-direction bending shaft 31 and the thickness-direction bending cylinder 32 are relatively rotated, whereby the blade member 1 which is passed from the blade member passing hole 33 to the first opening 34 via the second opening 35 is bent.

According to the thus configured blade member bending apparatus, after the blade member is bent in the width direction, the bending process in the thickness direction can be succeedingly performed, and therefore the production efficiency can be remarkably improved.

In the blade member bending apparatus of the invention, the portion of the blade member 1 to be compressed may be pressed to be compressed, in a state where tip end edges 13*a*, 14*a* of the pair of rotary press claws 13, 14 are tilted with respect to side faces 11, 11 of the blade member 1 which are opposed to the tip end edges, respectively.

According to the configuration, in the width-direction bending process, the compression amount of the blade member 1 is gradually increased or decreased as advancing toward one end edge in the width direction of the blade member 1, simply by pressing the rotary press claws 13, 14 against the blade member 1.

In the blade member bending apparatus of the invention, the tip end edges 13*a*, 14*a* of the pair of rotary press claws 13, 14 are tilted so that a compression amount with respect to the blade member 1 is gradually increased as advancing toward one end edge in the width direction of the blade member 1. According to the configuration, the extension length of a portion of the blade member 1 due to the compression is longer as the portion is closer to the one end edge in the width direction of the blade member, and is shorter as the portion is remoter from the one end edge in the width direction. Therefore, the compressed portion can be worked into a curved shape in which the one end edge in the width direction of the blade member 1 is swollen in the width direction as shown in FIG. 26.

In the blade member bending apparatus of the invention, tip end edges 13*a*, 14*a* of the pair of rotary press claws 13, 14 are tilted so that a compression amount with respect to the blade member 1 is gradually increased as advancing toward another end edge in the width direction of the blade member 1. According to the configuration, the extension length of a portion of the blade member 1 due to the compression is longer as the portion is closer to the other end edge in the width direction of the blade member, and is shorter as the portion is remoter from the other end edge in the width direction. Therefore, the compressed portion can be worked into a curved shape in which the other end edge in the width direction of the blade member 1 is swollen in the width direction as shown in FIG. 28.

In the blade member bending apparatus of the invention, the width-direction bending die portion 9 may comprise: a pair of rotary press claws 13, 14 which are tilted so that a compression amount with respect to the blade member 1 is gradually increased as advancing toward one end edge in the width direction of the blade member 1; and a pair of rotary press claws 13, 14 which are tilted so that a compression amount with respect to the blade member 1 is gradually increased as advancing toward another end edge in the width direction of the blade member 1. According to the configuration, the one end edge in the width direction of the blade member 1 can be worked into a curved shape which is swollen in the width direction, and the other end edge in the width direction of the blade member 1 can be worked into a curved shape which is swollen in the width direction.

In the blade member bending apparatus of the invention, the pair of rotary press claws 13, 14 may be attached to a pair of rotary press driving shaft 15 and rotary press driven shaft 16 which are placed on both sides across the blade member 1 in a manner that the rotary press claws are relatively rotatable in opposite directions, so that tip end edges 13*a*, 14*a* are projected to outsides of the shafts, respectively. According to the configuration, in a state where the pair of rotary press claws 13, 14 are held by the rotary press driving shaft 15 and the rotary press driven shaft 16, the width-direction bending process can be performed stably and surely in accordance with relative rotation of the driving and driven shafts.

In the blade member bending apparatus of the invention, the thickness-direction bending die portion 10 may be concentrically incorporated into the width-direction bending die portion 9. According to the configuration, the whole bending apparatus can be compacted and miniaturized.

The blade member bending apparatus of the invention may be configured so that the thickness-direction bending shaft 31 is formed into a cylindrical shape, the pair of rotary press driving shaft 15 and rotary press driven shaft 16 are housed in the thickness-direction bending shaft 31, and a rotary press cylinder 17 having blade member passing holes 18, 18 is inserted in a manner that the blade member passing holes 18, 18 communicate with the blade member passing hole 33 of the thickness-direction bending shaft 31. In this case, the thickness-direction bending shaft 31 may be fixed, and the thickness-direction bending cylinder 32 may be rotatable. According to the configuration, in a state where the thickness-direction bending shaft 31, the rotary press driving shaft 15, the rotary press driven shaft 16, the thickness-direction bending cylinder 32 are compactly housed, the thickness-direction bending process can be performed immediately after the width-direction bending process.

In the blade member bending apparatus of the invention, the thickness-direction bending die portion 10 may be disposed to be tiltable so that a tilting angle with respect to the blade member 1 is changeable in accordance with a curvature of the blade member 1 which has been bent in the width direction by the width-direction bending die portion 9. According to the configuration, bending in the thickness direction in accordance with the curvature of the blade member 1 bent in the width direction is enabled, whereby a blade member product having a complex curved face shape can be obtained highly accurately.

In the blade member bending apparatus of the invention, the thickness-direction bending die portion 10 may be juxtaposed with a downstream side of the width-direction bending die portion 9 in a blade member feeding direction. Also in this configuration, after the blade member 1 is bent in the width direction, the bending process in the thickness direction can be succeedingly performed.

In the blade member bending apparatus of the invention, the width-direction bending die portion 9 may be configured in a manner that a pair of rotary press claws 13, 14 which are tilted so that a compression amount with respect to the blade member 1 is gradually increased as advancing toward one end edge in the width direction of the blade member 1, and a pair of rotary press claws 13, 14 which are tilted so that the compression amount with respect to the blade member 1 is gradually increased as advancing toward another end edge in the width direction of the blade member 1 are juxtaposed in a blade member feeding direction. According to the configuration, the one end edge in the width direction of the blade member 1 can be worked into a curved shape which is swollen in the width direction, and the other end edge in the width direction of the blade member can be worked into a curved shape which is swollen in the width direction.

According to the blade bending method and apparatus of the invention, in succession to a process of bending a blade member in the width direction, a process of bending a blade member in the thickness direction can be continuously performed, whereby the production efficiency can be remarkably improved.

BRIEF DESCRIPTION OF THE DRAWINGS

FIG. 10 is a sectional view taken along the line B-B of FIG. 9.

FIG. 11 is a side view of the width-direction bending die portion of FIG. 9.

FIG. 12 is a perspective view of the width-direction bending die portion of FIG. 9.

FIG. 13 is an operation diagram of the width-direction bending die portion.

FIG. 14 is a plan view of a rotary press cylinder.

FIG. 15 is a front view of the rotary press cylinder.

FIG. 16 is a side view of the rotary press cylinder.

FIG. 17 is a perspective view of the rotary press cylinder.

FIG. 18 is a plan view of a thickness-direction bending shaft of the thickness-direction bending die portion.

FIG. 19 is a sectional view taken along the line C-C of FIG. 18.

FIG. 20 is a plan view of the thickness-direction bending shaft of the thickness-direction bending die portion.

FIG. 21 is a sectional view taken along the line D-D of FIG. 20.

FIG. 22 is a perspective view of the thickness-direction bending shaft of the thickness-direction bending die portion.

FIG. 23 is an exploded perspective view of the blade member bending apparatus of FIG. 1.

FIGS. 24A and 24B are front views of a pair of rotary press claws of the thickness-direction bending die portion, FIG. 24A shows a state where the pair of rotary press claws separate from each other, and FIG. 24B shows a state where the pair of rotary press claws approach each other to compress a blade member.

FIGS. 25A and 25B are front views of a pair of rotary press claws in another embodiment, FIG. 25A shows a state where the pair of rotary press claws separate from each other, and FIG. 25B shows a state where the pair of rotary press claws approach each other to compress a blade member.

FIGS. 29A and 29B are transverse sectional plan views of the width-direction bending die portion and the thickness-direction bending die portion, FIG. 29A shows a state before the blade member is bent in the thickness direction, and FIG. 29B shows a state after the blade member is bent in the thickness direction.

FIG. 30 is a transverse sectional plan view of the width-direction bending die portion and the thickness-direction bending die portion, showing a state where the blade member in the other embodiment is bent in the thickness direction.

FIG. 31 is a plan view showing another example of the blade member which is bent in the thickness direction.

FIG. 32 is a transverse sectional plan view showing a width-direction bending die portion in the other embodiment in correspondence to FIG. 10.

FIG. 34 is a transverse sectional plan view of a blade member bending apparatus of a further embodiment.

FIG. 36 is a perspective view showing a use state of a rotary die.

FIG. 37 is a side view showing the use state of the rotary die.

DESCRIPTION OF THE PREFERRED EMBODIMENTS

Figure 1:
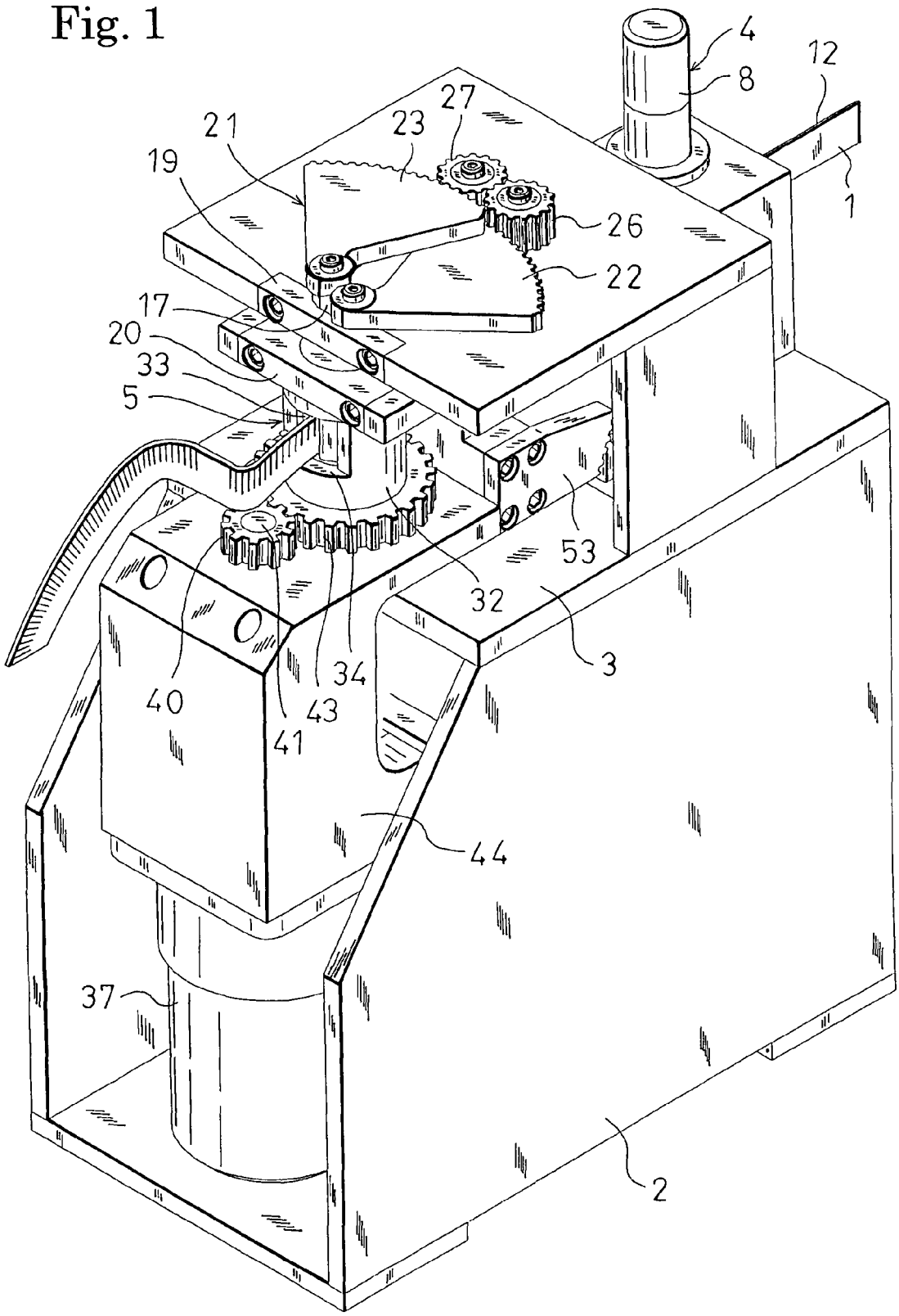
FIG. 1 is an external perspective view of a blade member bending apparatus showing an embodiment of the invention.
Figure 2:
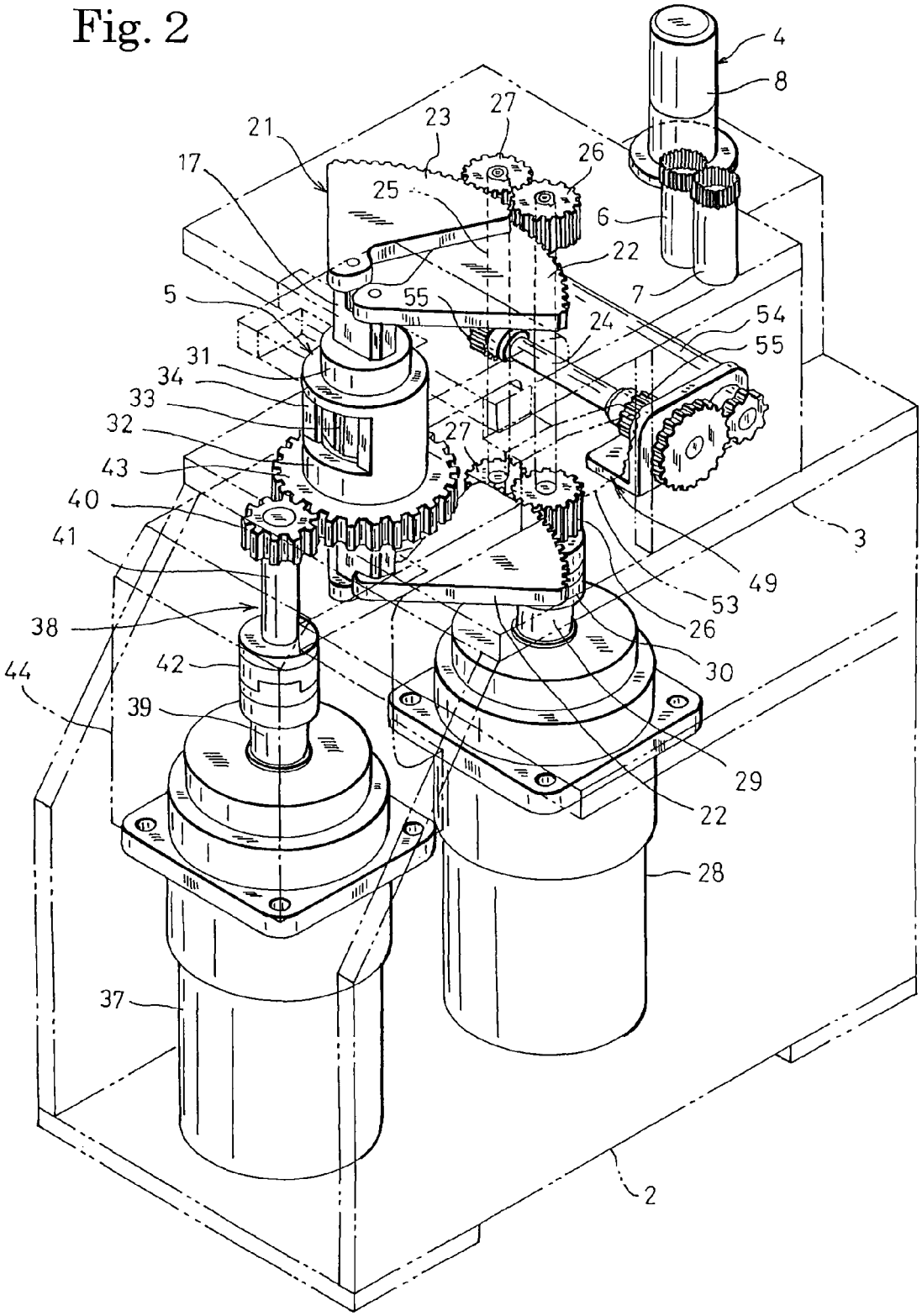
FIG. 2 is a transparent view showing the internal structure of the blade member bending apparatus of FIG. 1.
Figure 3:
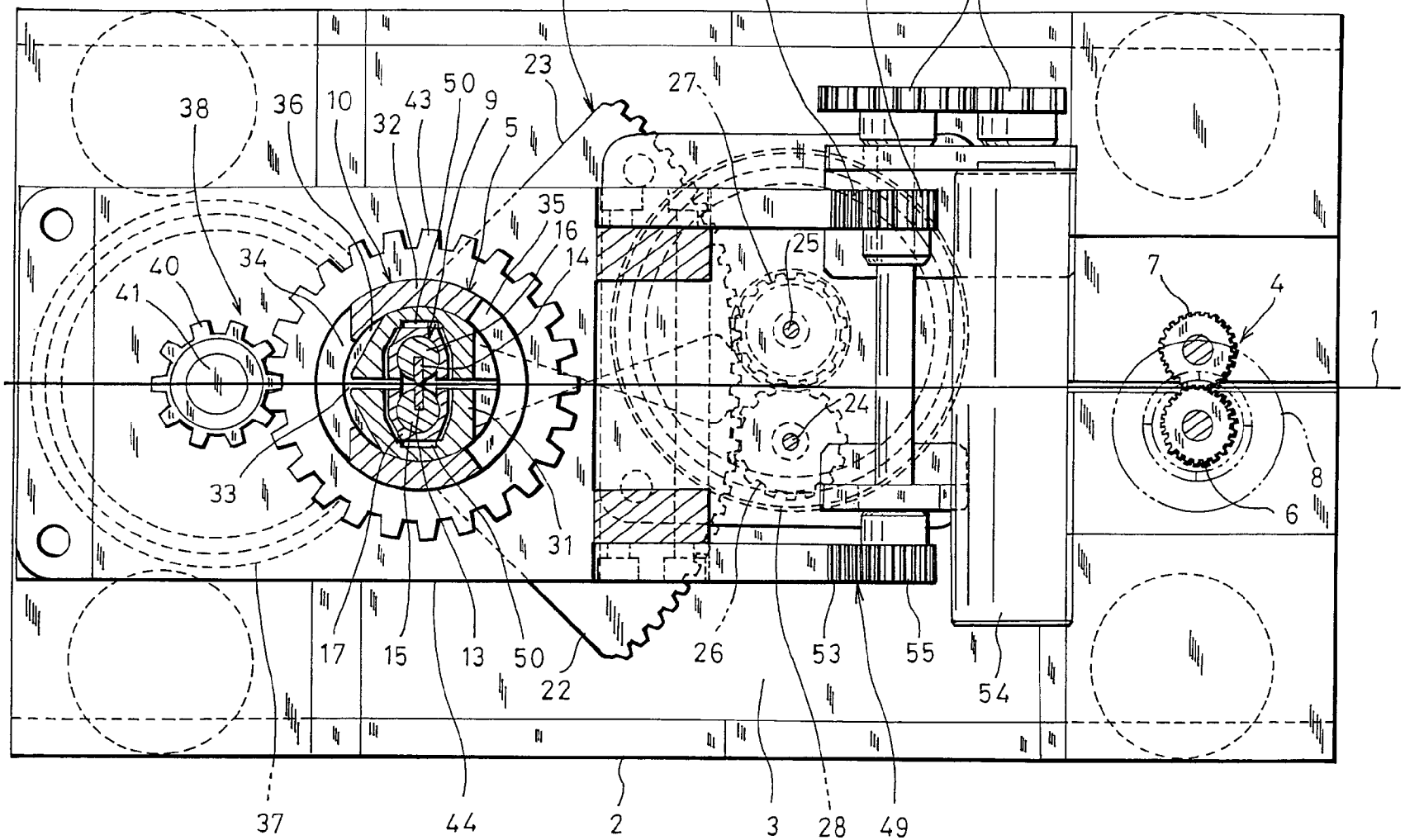
FIG. 3 is a transverse sectional plan view of the blade member bending apparatus of FIG. 1.
Figure 4:
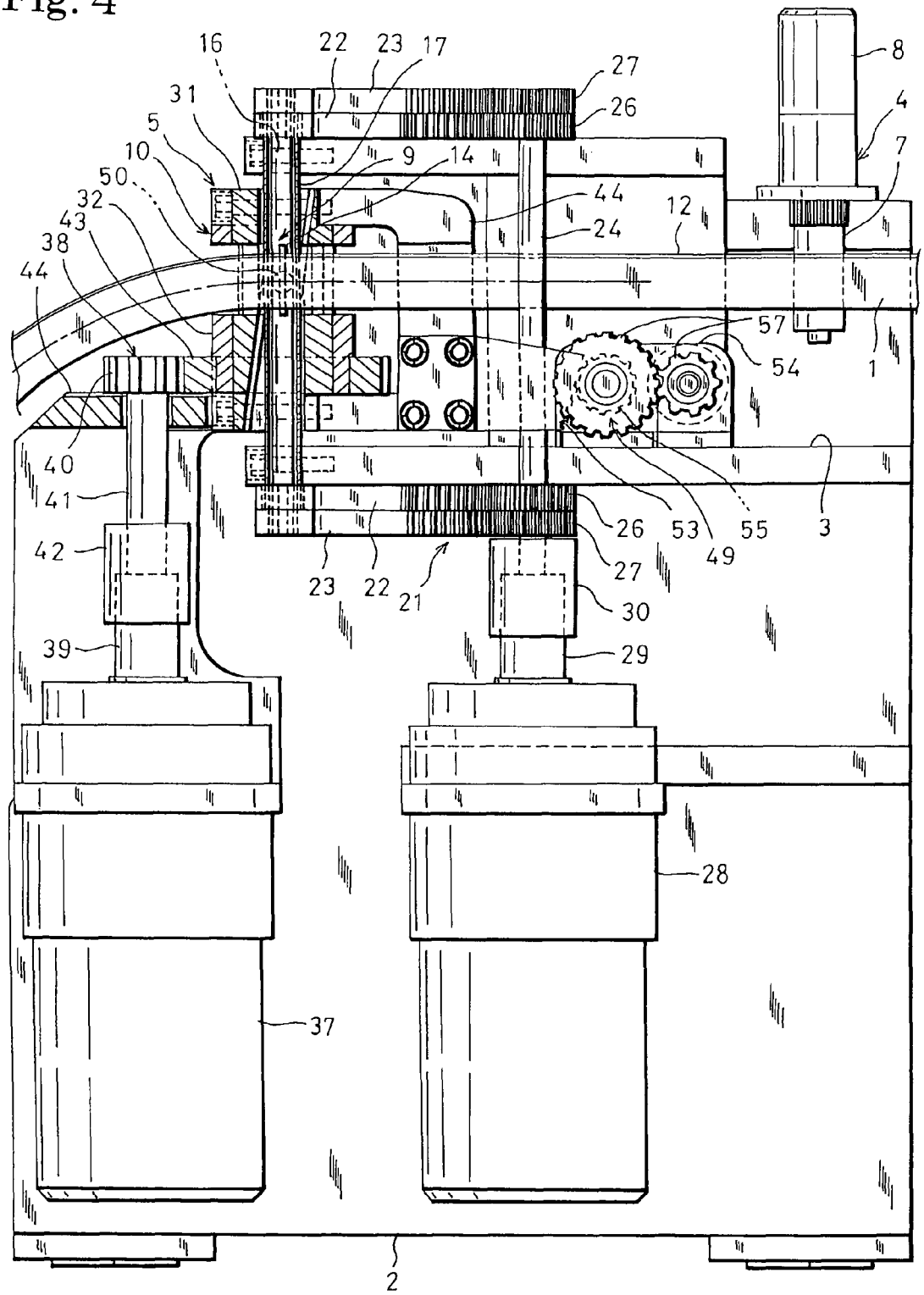
FIG. 4 is a side view of the blade member bending apparatus of FIG. 1.

FIG. 1 is an external perspective view of a blade member bending apparatus showing an embodiment of the invention, FIG. 2 is a transparent view showing the internal structure of the blade member bending apparatus, FIG. 3 is a transverse sectional plan view of the blade member bending apparatus, and FIG. 4 is a side view of the blade member bending apparatus.

In the blade member bending apparatus, as shown in FIGS. 1 to 4, a working table 3 is disposed on a chassis 2, and a blade member feeding portion 4 and a working die portion 5 are disposed on the working table 3. The blade member feeding portion 4 comprises a pair of blade member feeding rollers 6, 7 which are placed on both sides across a strip-like blade member 1 having a blade edge 12 in one end edge in the width direction. The pair of blade member feeding rollers 6, 7 are intermittently rotated in opposite directions by a blade member feeding motor 8, whereby the blade member 1 is intermittently fed to the working die portion 5 with directing the blade edge 12 upward.

Figure 6:
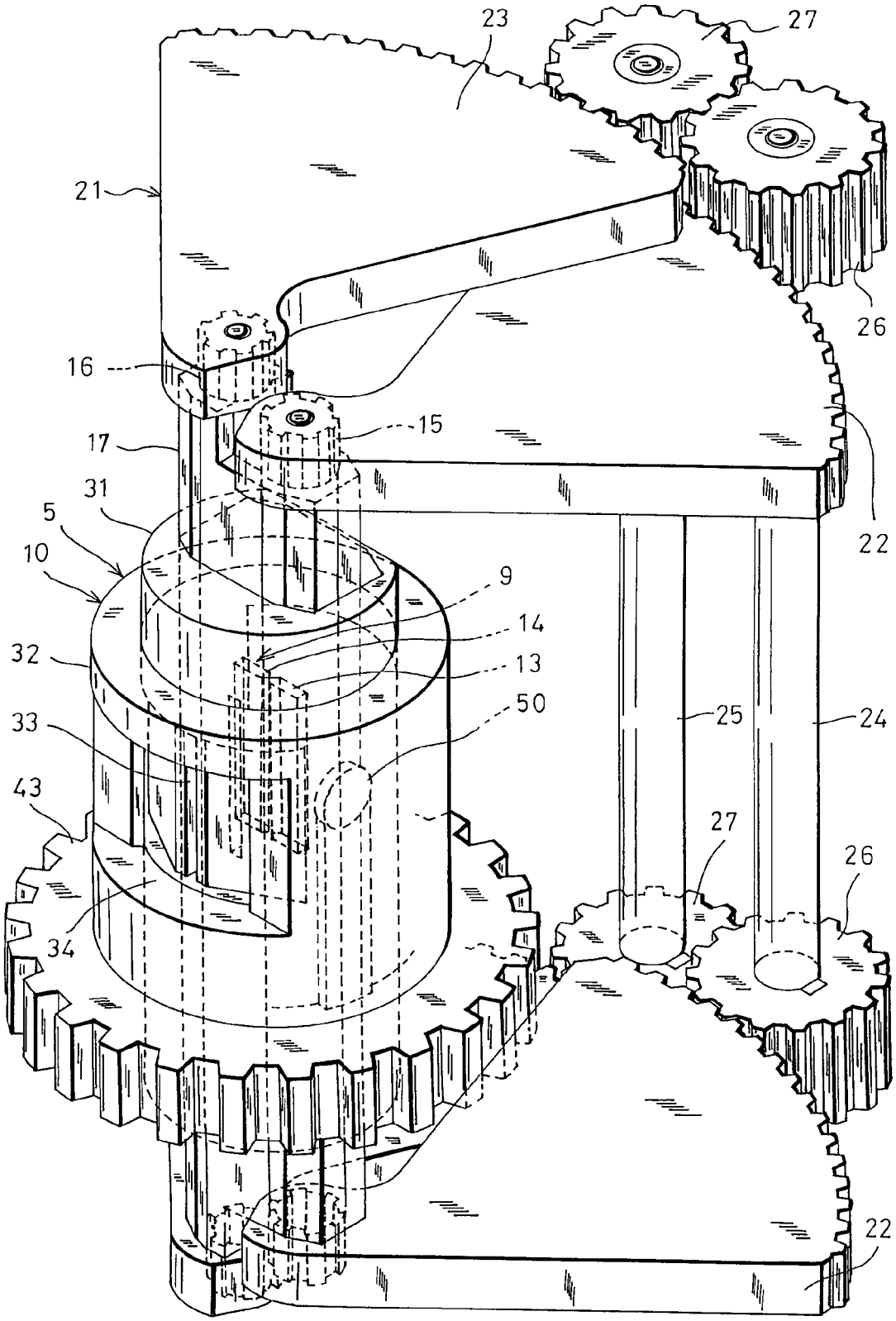
FIG. 6 is an external perspective view of a width-direction bending die portion and the thickness-direction bending die portion.
Figure 7:
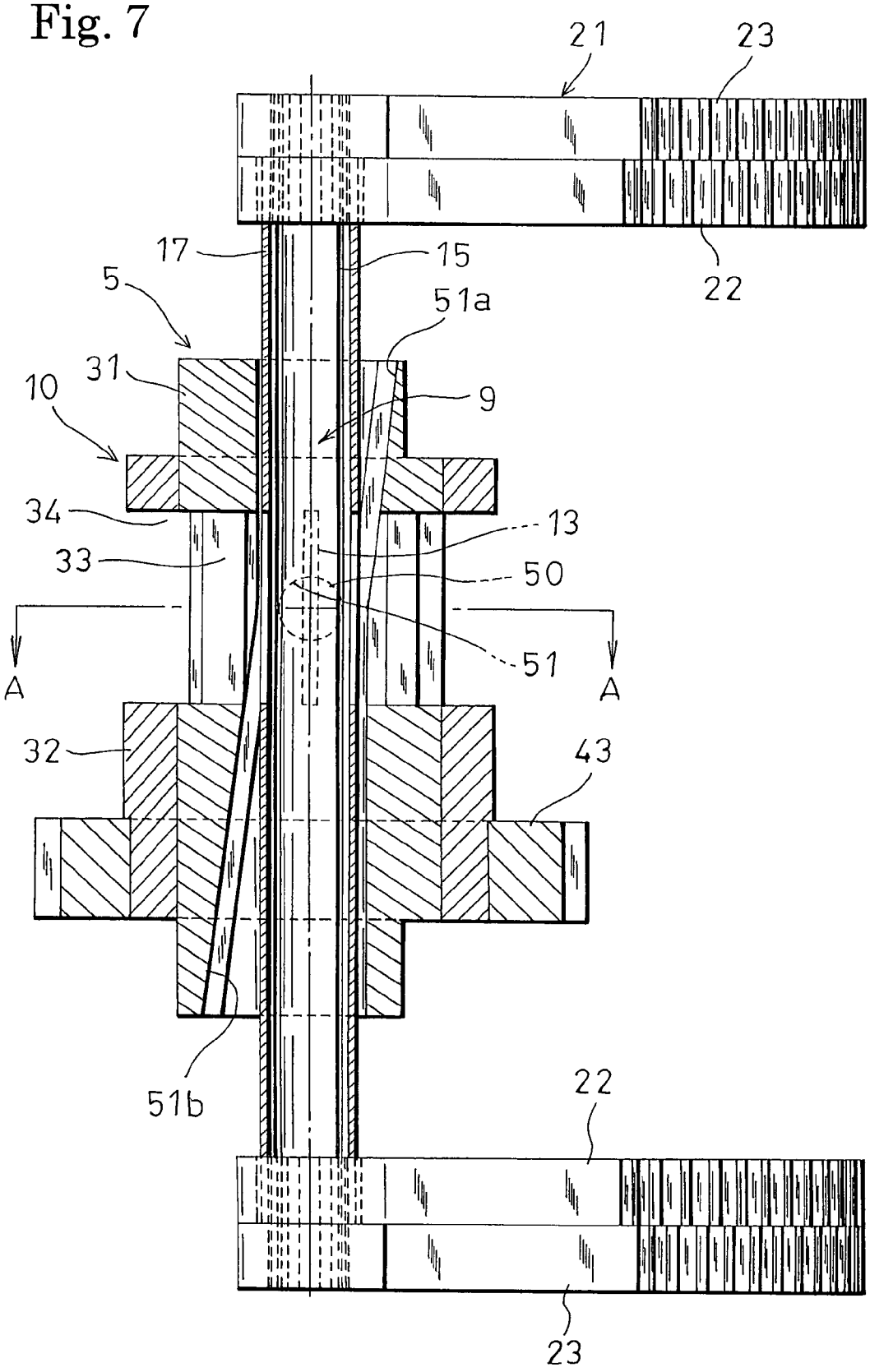
FIG. 7 is a longitudinal sectional side view of the width-direction bending die portion and the thickness-direction bending die portion.
Figure 8:
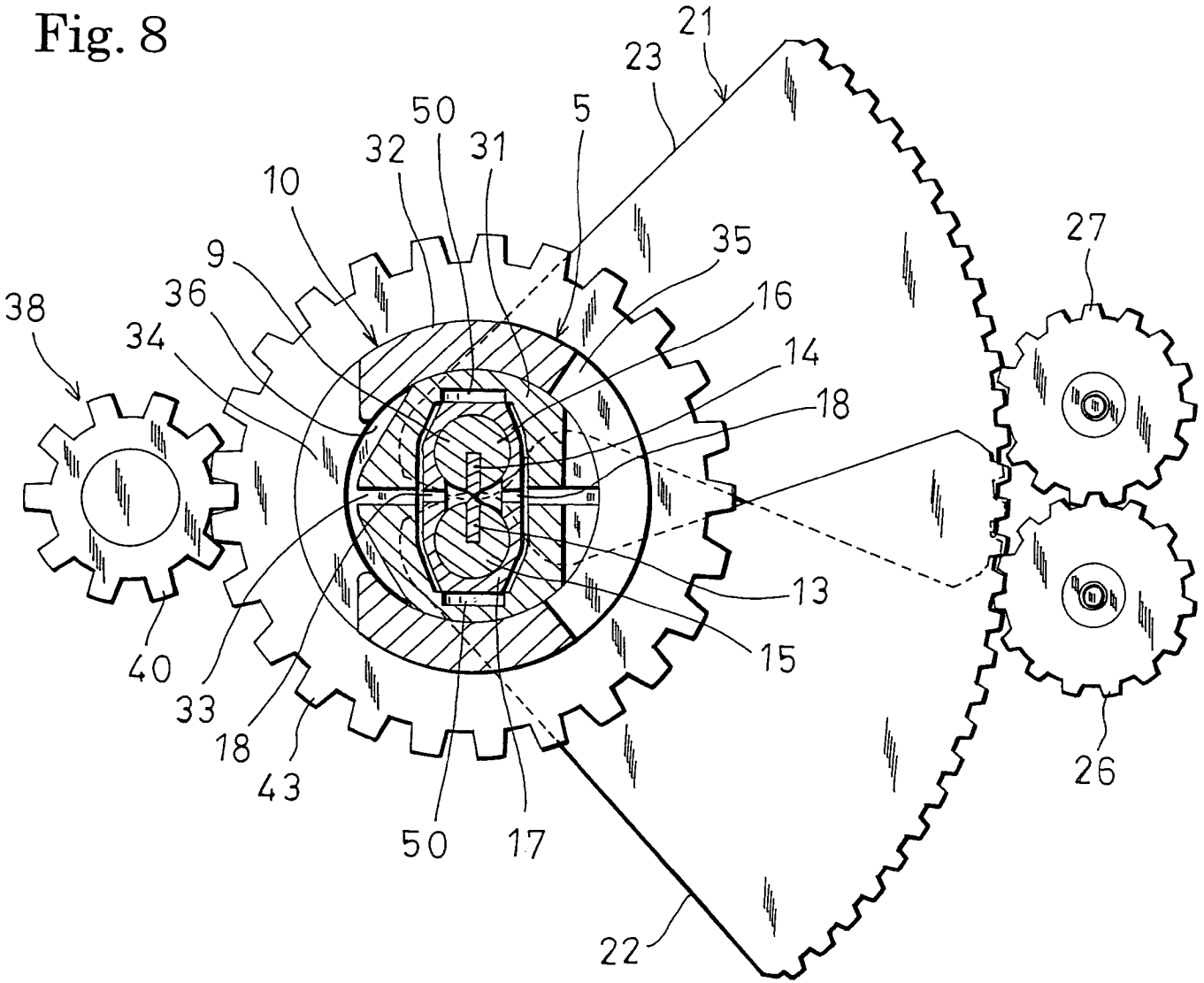
FIG. 8 is a sectional view taken along the line A-A of FIG. 7.
Figure 9:
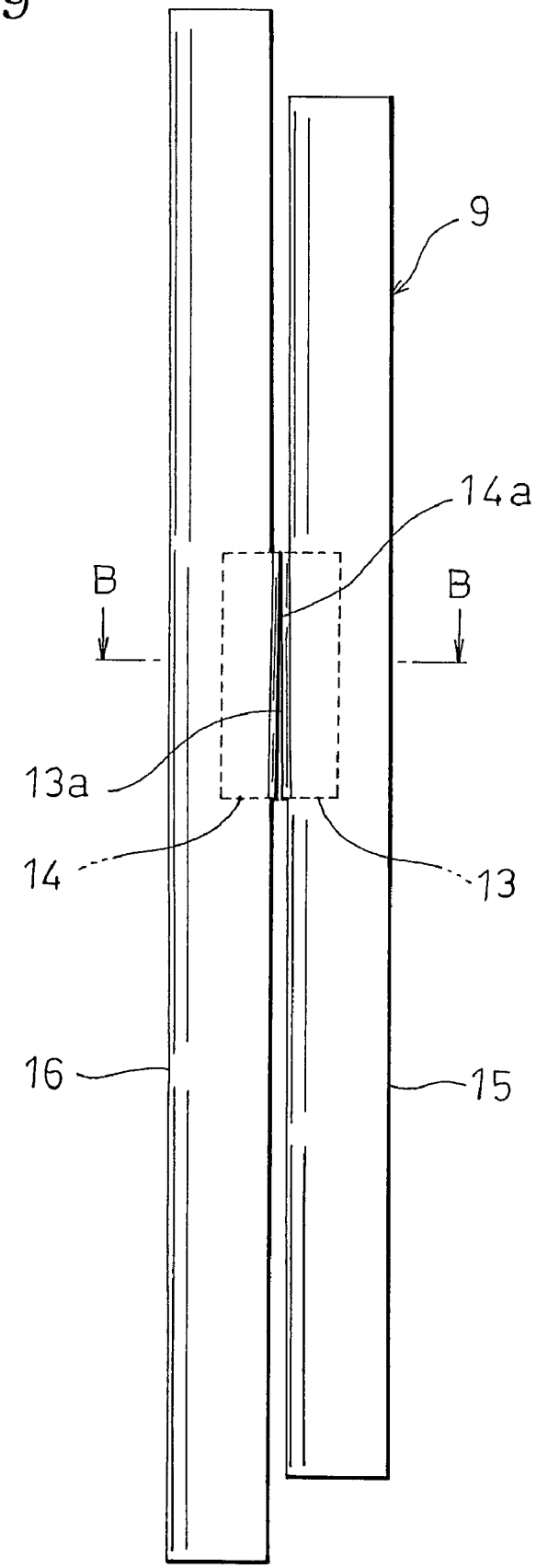
FIG. 9 is a front view of the width-direction bending die portion.
Figure 1:
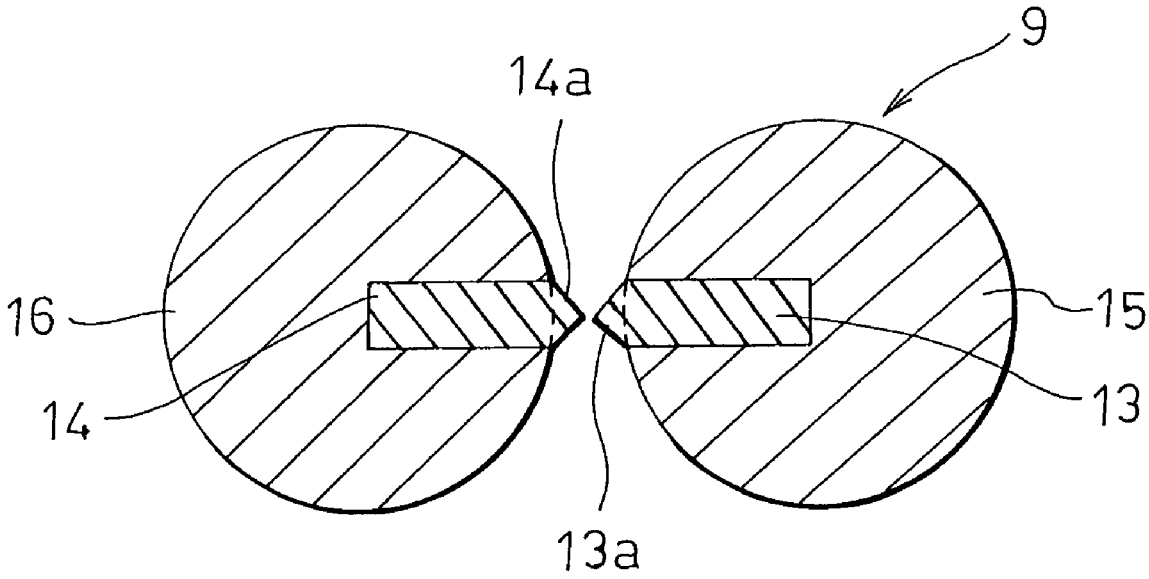
Figure 1:
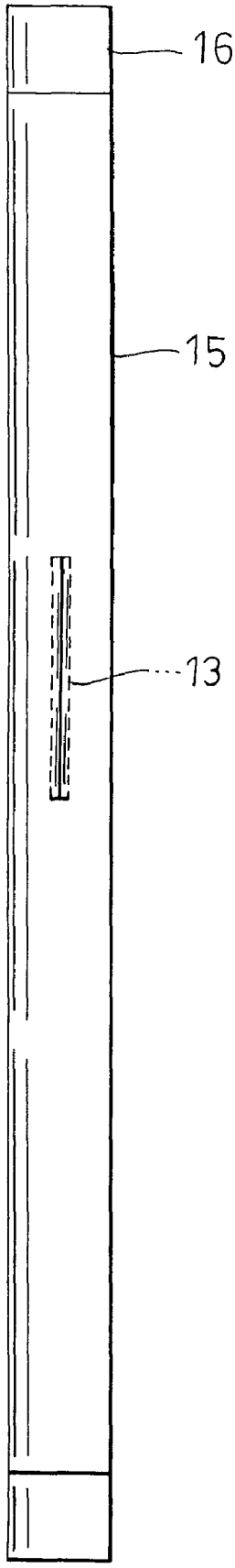
Figure 1:
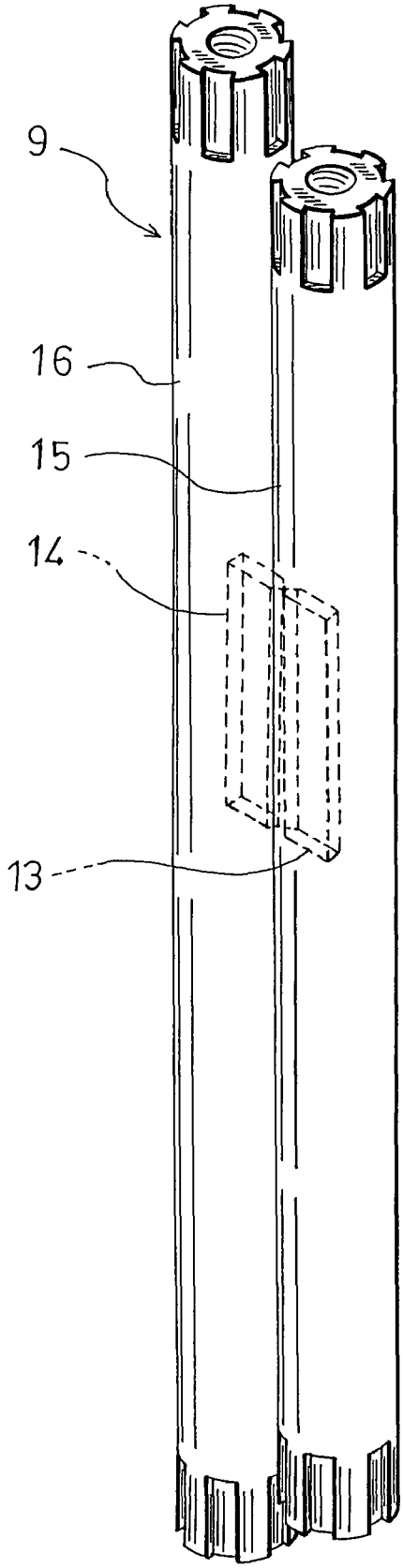
Figure 1:
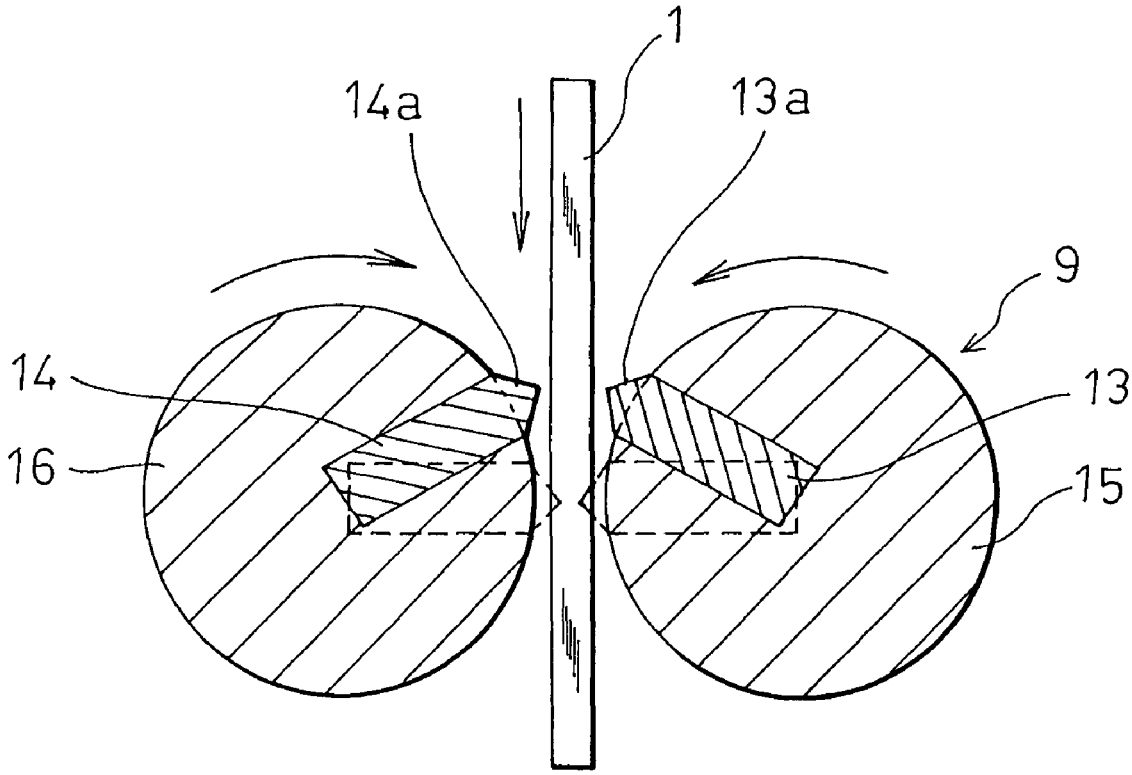
Figure 1:
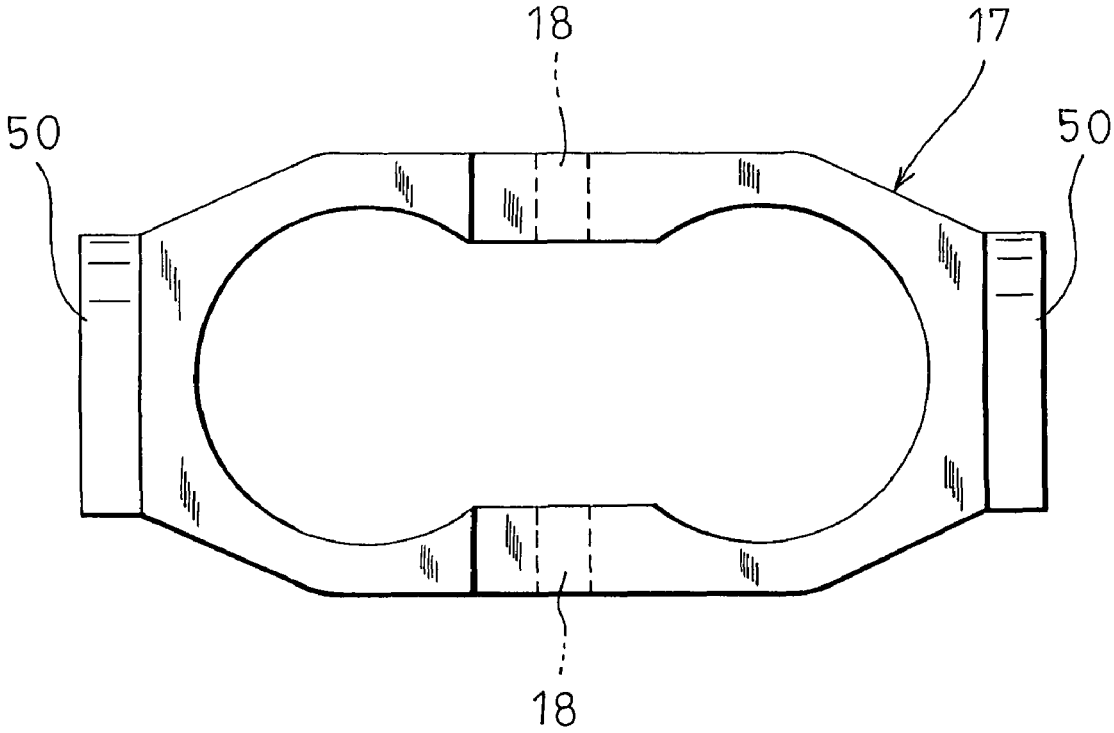
Figure 1:
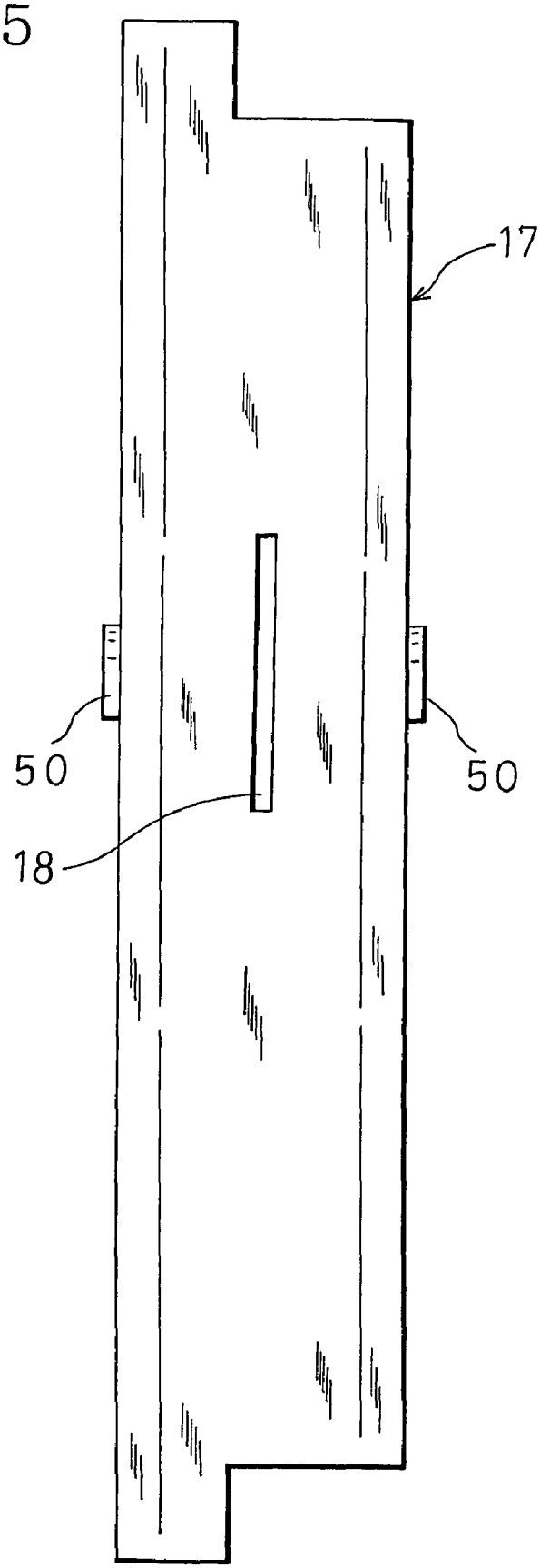
Figure 1:
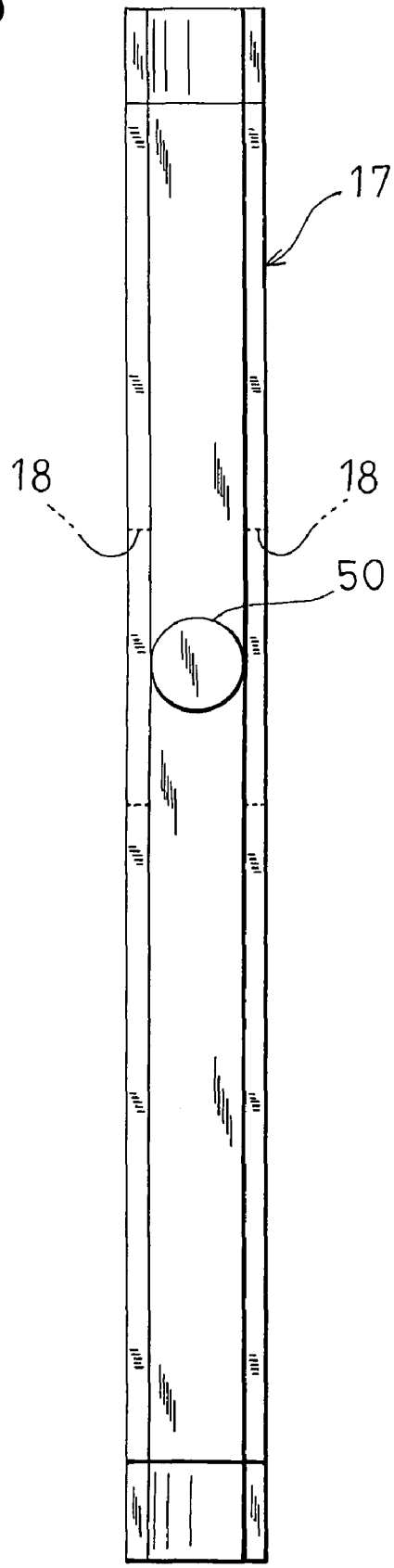
Figure 1:
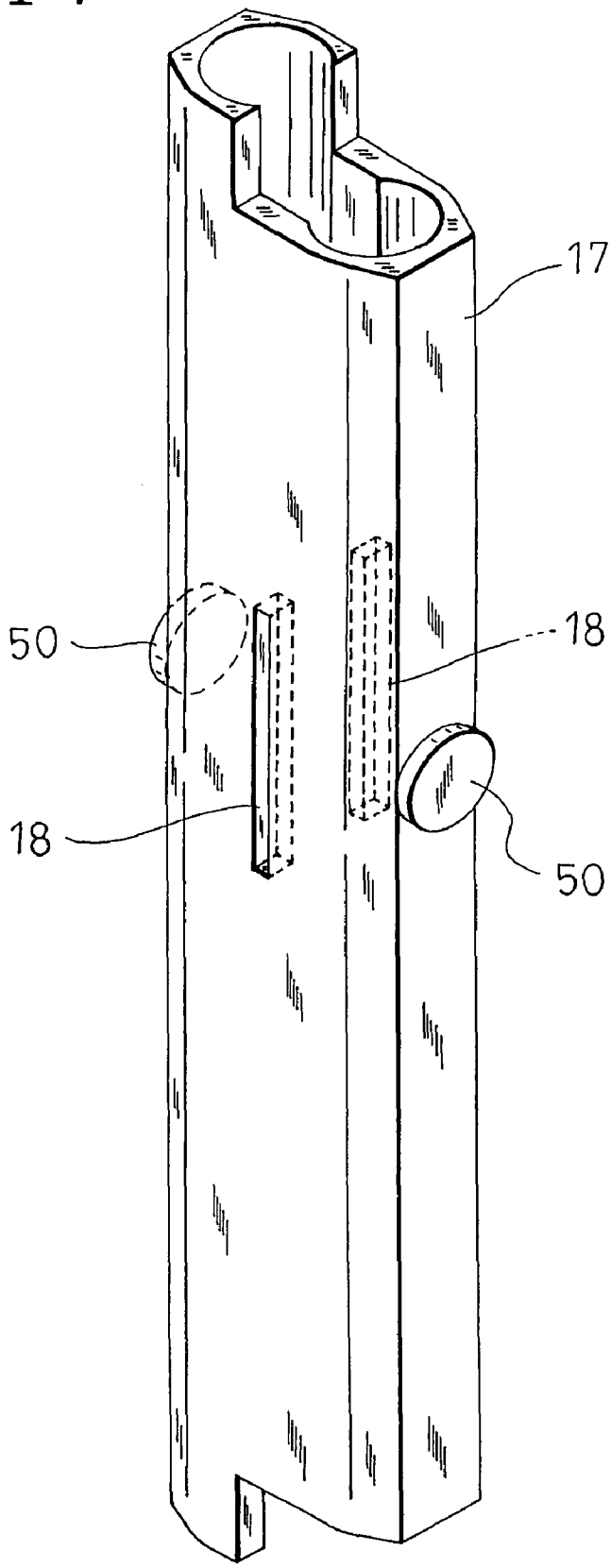
Figure 1:
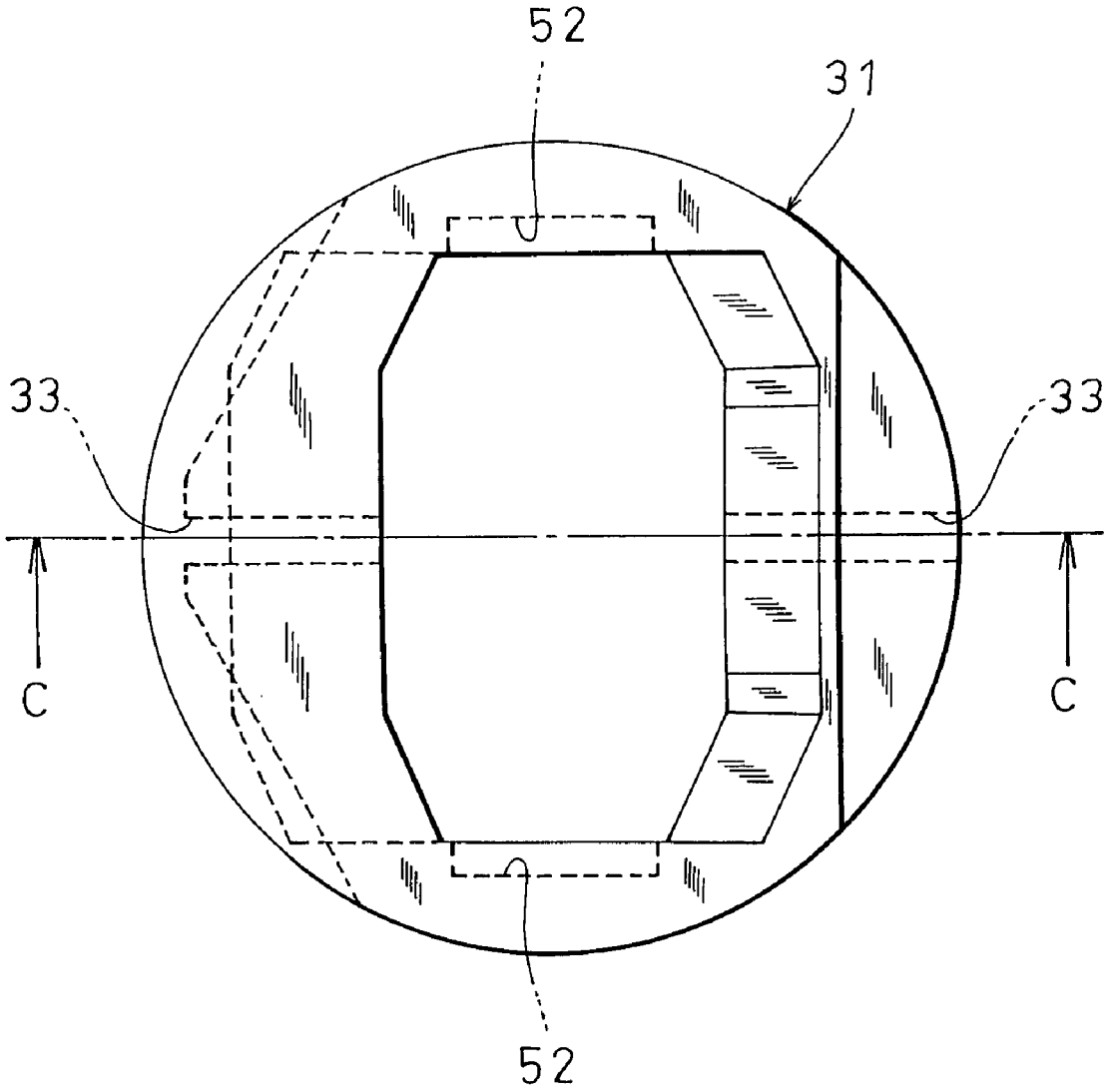
Figure 1:
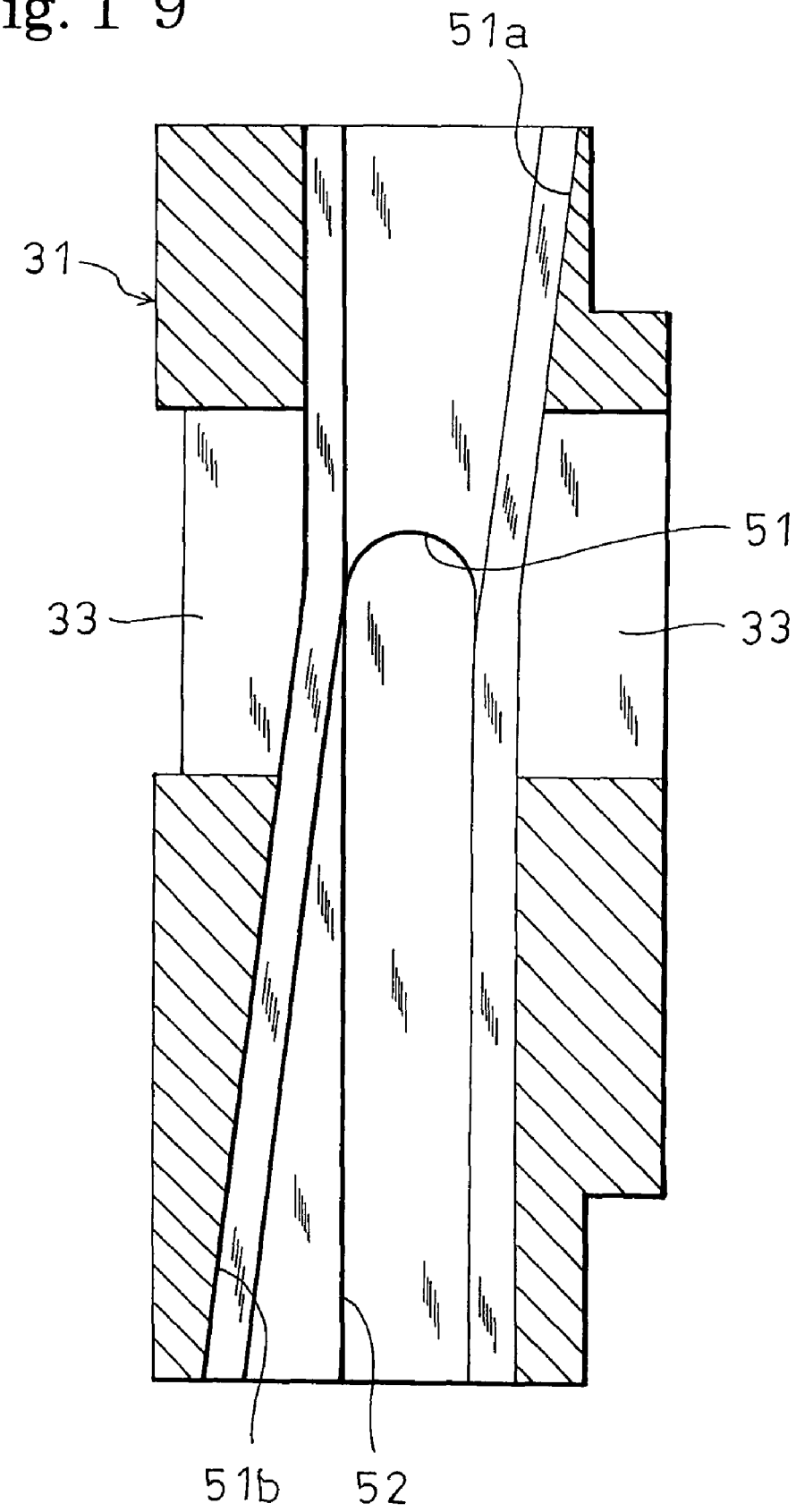
Figure 2:
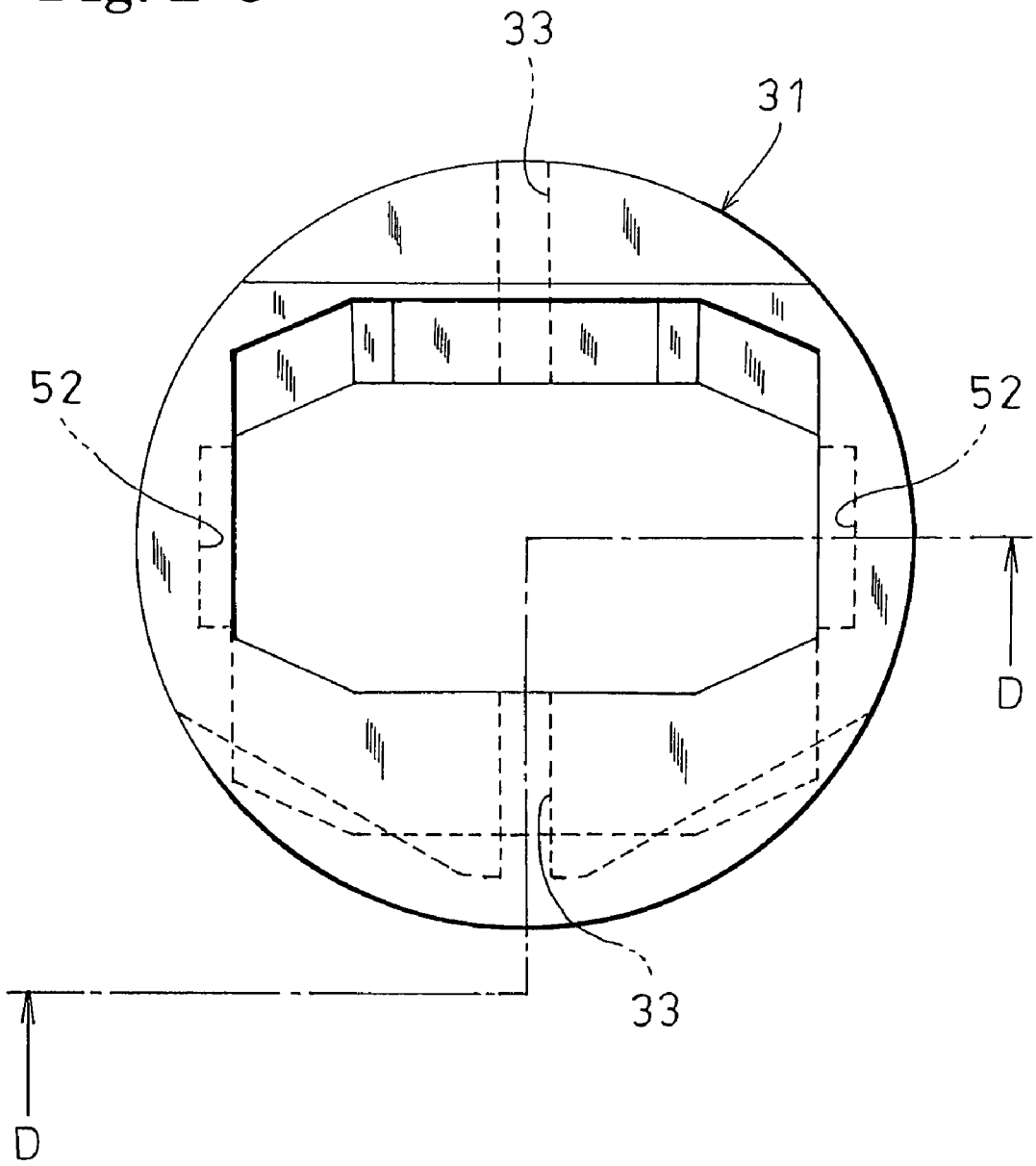
Figure 2:
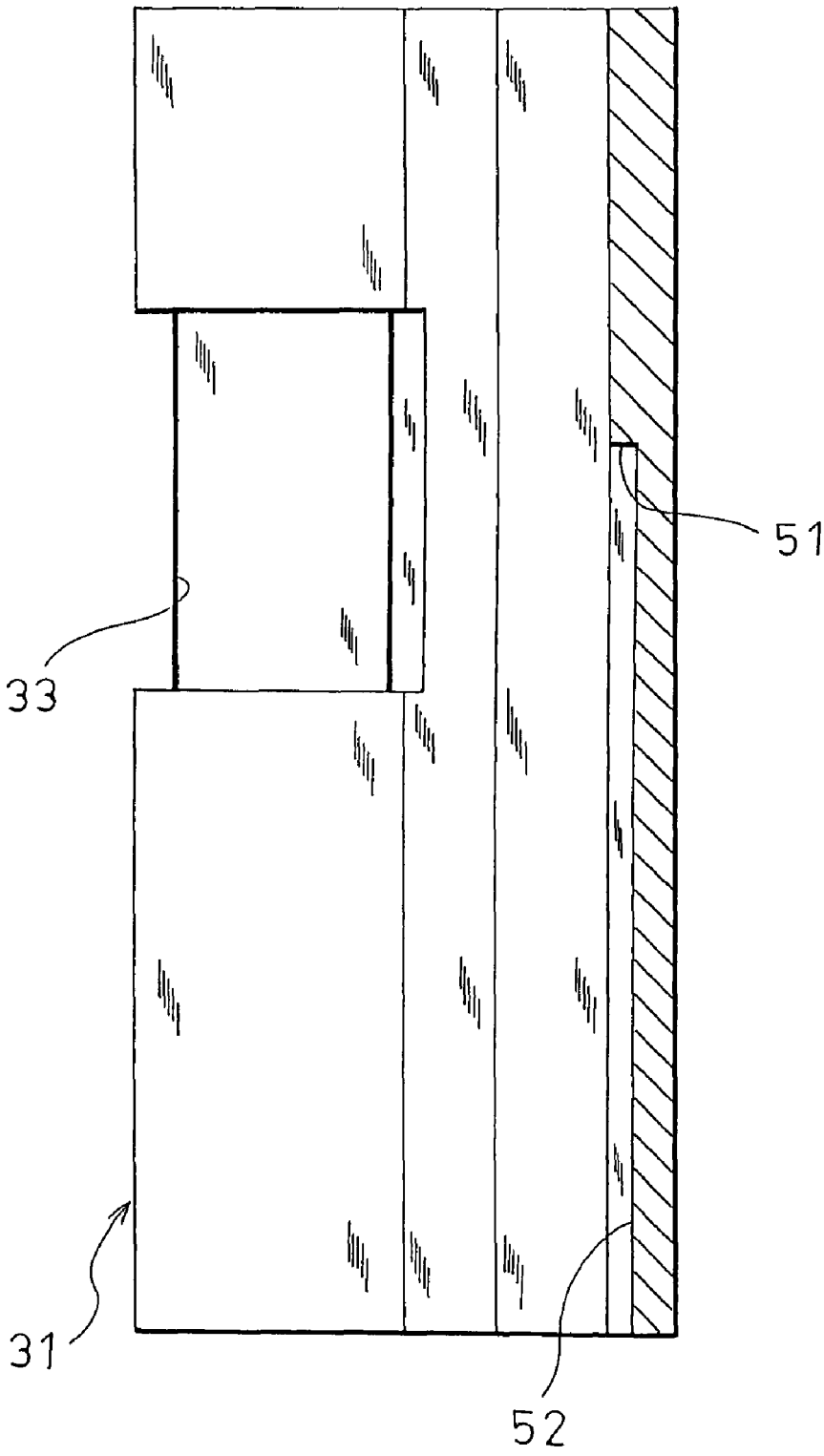
Figure 2:
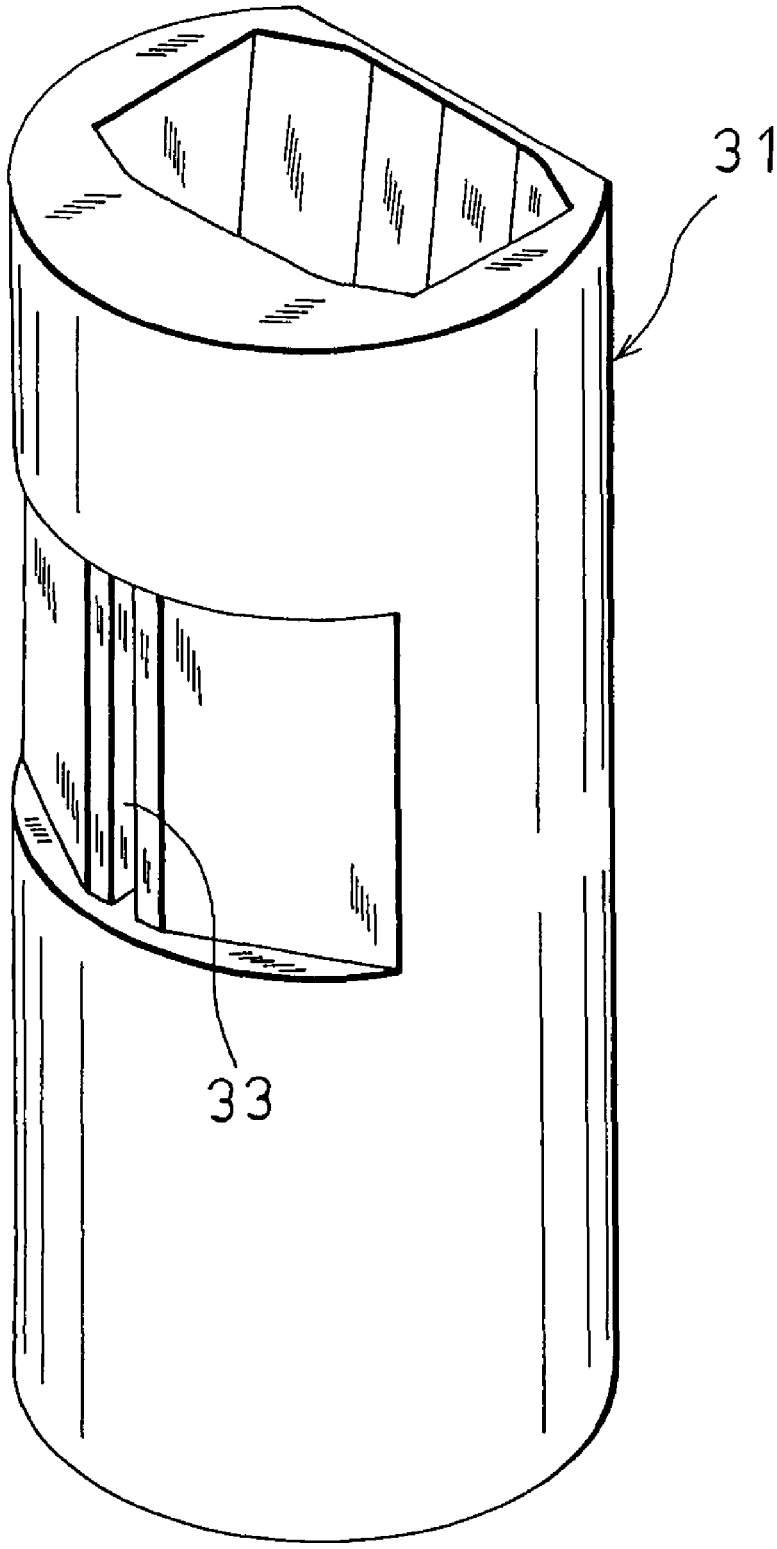
Figure 2:
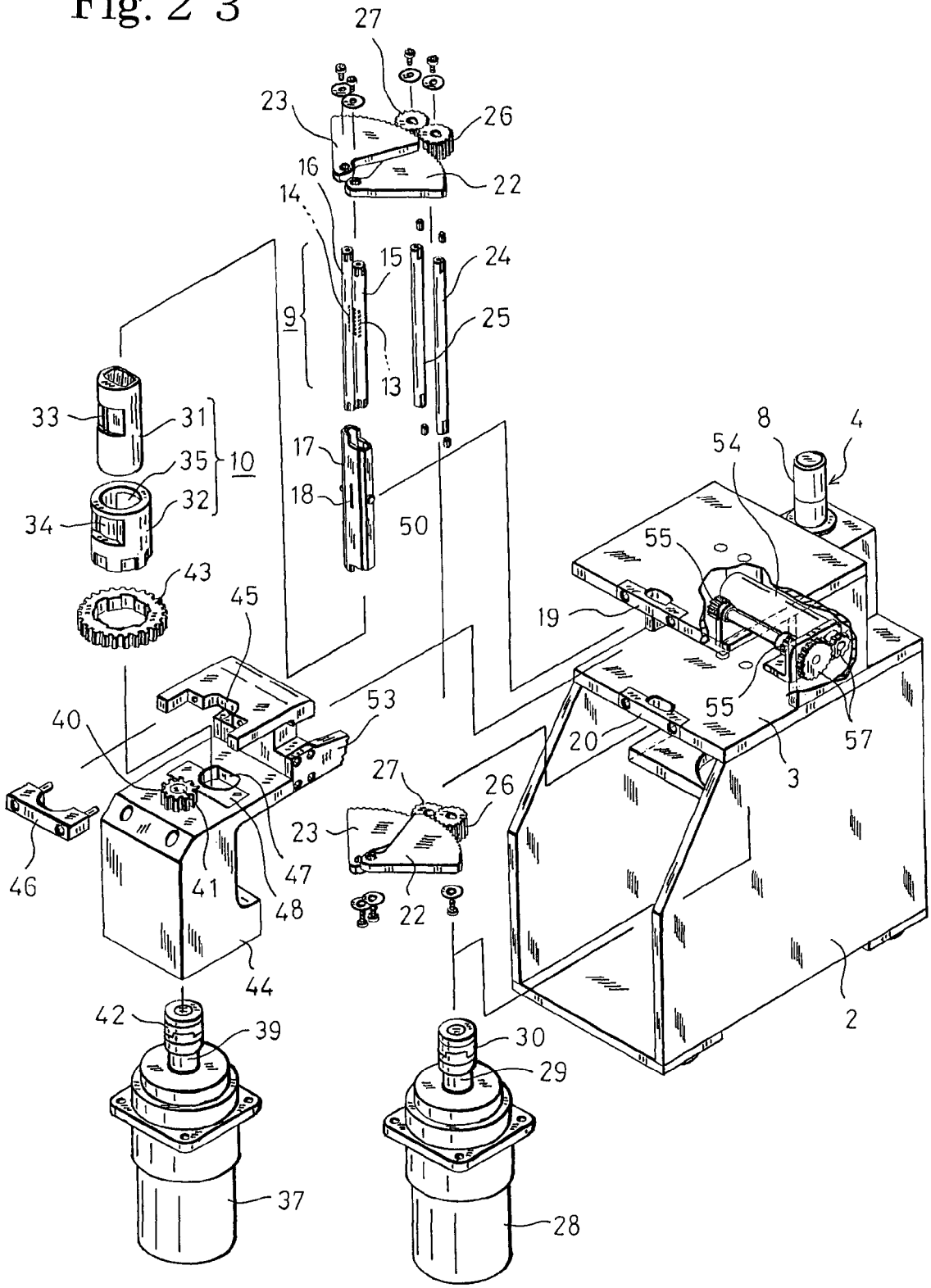

As shown in FIGS. 6 to 8, the working die portion 5 comprises: a width-direction bending die portion 9 which bends the blade member in the width direction; and a thickness-direction bending die portion 10 which, after the width-direction bending process, bends the blade member in the thickness direction. The width-direction bending die portion 9, and the thickness-direction bending die portion 10 are concentrically placed.

As shown in FIGS. 9 to 13, the width-direction bending die portion 9 comprises a pair of rotary press claws 13, 14 which are placed on both sides across the blade member 1 in a manner that they are relatively rotatable in opposite directions. The rotary press claws 13, 14 comprise tip end edges 13*a*, 14*a* extending along the width direction of the blade member 1, respectively, and are formed so as to have a V-like section shape. The rotary press claws are attached to a pair of rotary press driving shaft 15 and rotary press driven shaft 16 which are opposed in a vertical posture to each other on both sides across the blade member 1 in a manner that the rotary press claws are rotatable in opposite directions, so that their tip end edges 13*a*, 14*a* are projected to outsides of the shafts, respectively. The rotary press driving shaft 15 and the rotary press driven shaft 16 are housed in a rotary press cylinder 17 shown in FIGS. 15 to 17, in a state shown in FIGS. 6 to 8. In FIGS. 15 to 17, in an intermediate portion in the height direction of the rotary press cylinder 17, blade member passing holes 18, 18 which allow the blade member 1 to pass therethrough are formed at places which are symmetric about the axis of the cylinder 17. As shown in FIG. 8, the blade member passing holes 18, 18 communicate with a gap between the rotary press driving shaft 15 and the rotary press driven shaft 16. As shown in FIGS. 1 and 23, the upper and lower ends of the rotary press cylinder 17 are held to the working table 3 by cylinder holders 19, 20, whereby the rotary press cylinder is attached in a vertical posture.

As shown in FIG. 6, the rotary press driving shaft 15 and the rotary press driven shaft 16 are disposed so that they are relatively rotated in opposite directions in the rotary press cylinder 17 by a rotary press claw driving mechanism 21. In the rotary press claw driving mechanism 21, sector drive gears 22, 23 are fixed respectively to the upper and lower ends of the rotary press driving shaft 15 and rotary press driven shaft 16 which are projected from the upper and lower ends of the rotary press cylinder 17. Drive pinions 26, 27 are fixed respectively to the upper and lower ends of driving and driven shafts 24, 25 so that adjacent ones of the drive pinions 26, 27 mesh with each other. The drive pinions 26, 27 mesh with the drive gears 22, 23, respectively. As shown in FIGS. 2 and 4, the lower end of the driving shaft 24 is coupled via a coupling 30 to a rotation shaft 29 of a forward and rearward drive motor 28 for a width-direction bending process. As a result, by the driving of the forward and rearward drive motor 28, the rotary press driving shaft 15 and the rotary press driven shaft 16 are rotated relatively forwardly and relatively rearwardly in opposite directions in the rotary press cylinder 17.

As shown in FIGS. 24A and 24B, the pair of rotary press claws 13, 14 are placed so that their respective tip end edges 13*a*, 14*a* are opposed to each other, and the blade member 1 is fed between the edges with directing the blade edge 12 upward. As described above, the tip end edges 13*a*, 14*a* have a shape extending along the width direction of the blade member 1, and are formed so as to have a V-like section shape.

As seen from FIG. 24B, in a state where the tip end edges 13*a*, 14*a* of the pair of rotary press claws 13, 14 clamp the blade member 1 which is fed in a vertical posture between the edges with directing the blade edge 12 upward, the tip end edges 13*a*, 14*a* are tilted in a downward flare-like manner with respect to vertical side faces 11, 11 of the blade member 1. In the illustrated example, the tilting angle θ1 of the tip end edge 13*a* of the one rotary press claw 13 with respect to the side face 11 of the blade member 1, and the tilting angle θ2 of the tip end edge 14*a* of the other rotary press claw 14 are set to be equal to each other. However, it may be contemplated that the tilting angles θ1 and θ2 are different from each other.

Next, a method of bending the blade member 1 in the width direction by using the thus configured width-direction bending die portion 9 will be described.

In a state where the blade member 1 is clamped from the both sides by the pair of blade member feeding rollers 6, 7 of the blade member feeding portion 4, the pair of blade member feeding rollers 6, 7 are intermittently rotated to intermittently feed the blade member 1 to the width-direction bending die portion 9 with directing the blade edge 12 upward. During stoppage of the process of feeding the blade member 1, the pair of rotary press claws 13, 14 approach and separate from each other one time or a required number of times.

Figure 26:
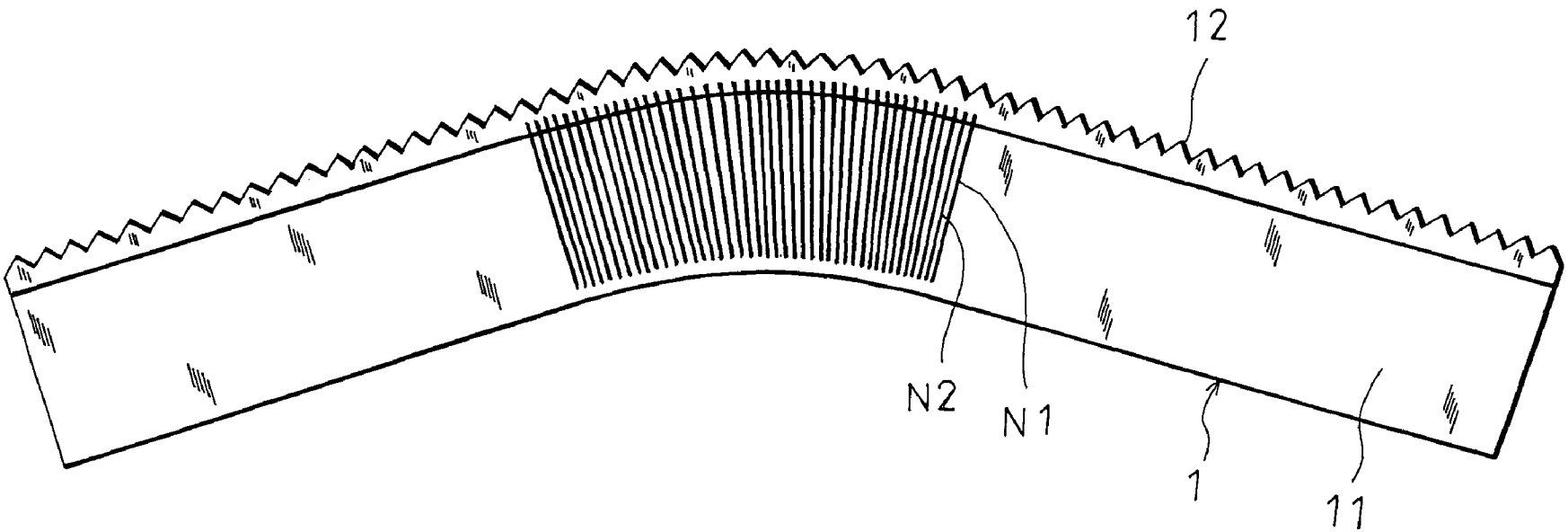
FIG. 26 is a side view of a blade member which is bent in the width direction.

In a state where the tip end edges 13*a*, 14*a* of the rotary press claws 13, 14 separate from each other as shown in FIG. 24A, the blade member 1 is fed in a vertical posture between the edges with directing the blade edge 12 upward, and then the forward and rearward drive motor 28 for the width-direction bending process starts to operate, thereby causing the tip end edges 13*a*, 14*a* of the rotary press claws 13, 14 to approach each other. As a result, as indicated by the arrow F in FIG. 24B, the tip end edges 13*a*, 14*a* of the rotary press claws 13, 14 are pressed against the side faces 11, 11 of the blade member 1. Therefore, the blade member 1 is clamped by the pair of rotary press claws 13, 14 to be compressed in the thickness direction, and extended in the longitudinal direction of the blade member 1 in accordance with the compression amount, so as to be bent in the width direction. The above is a width-direction bending step. As shown in FIG. 26, press marks N1, N2, . . . of the tip end edges 13*a*, 14*a* linearly remain at the number of which is equal to the number of repeated pressing operations. In FIG. 24B, the maximum compression amount of the blade member 1 which is compressed by pressing of the tip end edge 14*a* of the one rotary press claw 14, i.e., the maximum amount of reduction of the thickness of the blade member 1 which is caused by the compression is indicated by the letter d.

The tip end edges 13*a*, 14*a* are tilted in a downward flare-like manner with respect to side faces 11, 11 of the blade member 1. In the width-direction bending step, therefore, the compression amount in the compressed portion of the blade member 1 is gradually increased as advancing toward one end edge (the blade edge 12) in the width direction. Consequently, the extension length of a portion of the blade member 1 due to the compression is longer as the portion is closer to the blade edge 12, and is shorter as the portion is remoter from the blade edge 12. Along with the extension of the compressed portion which is closest to the blade edge 12, the blade edge 12 is extended by a substantially same length. Therefore, the compressed portion is bent into a curved shape in which the blade edge 12 of the blade member 1 is swollen in the width direction as shown in FIG. 26.

When the compression amount of the blade member 1 due to the tip end edges 13*a*, 14*a* is adequately adjustedly increased or decreased, or the pitch of compressed portions is adequately adjustedly lengthened or shortened, the bending degree of the blade member 1 in the width direction can be changed. Therefore, the radius of curvature P (see FIG. 5) of the blade member 1 which is bent in the width direction can be freely adjusted.

The blade member 1 is clampingly pressed by the tip end edges 13*a*, 14*a* of the rotary press claws 13, 14 to be compressed. Therefore, the pressing force due to the tip end edges 13*a*, 14*a* is efficiently concentrated to the compressed portion of the blade member 1 to efficiently perform the bending process on the blade member 1 in the width direction.

Figure 27:
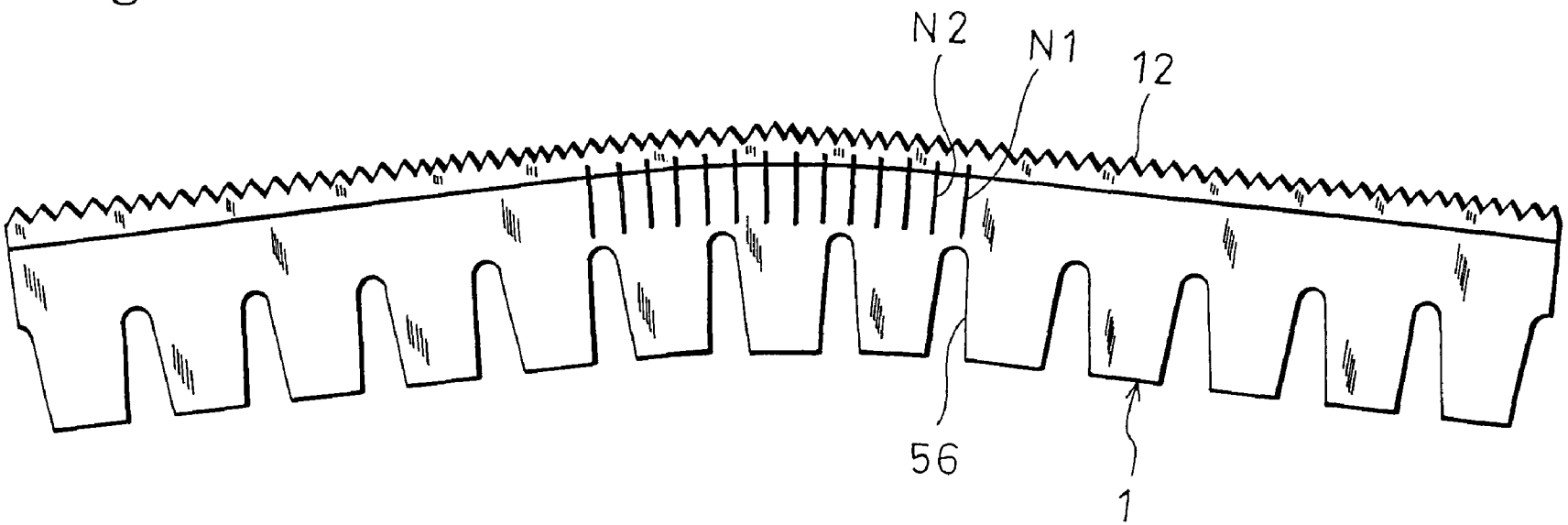
FIG. 27 is a side view of a state where a blade member in the other embodiment is bent in the width direction.
Figure 39:
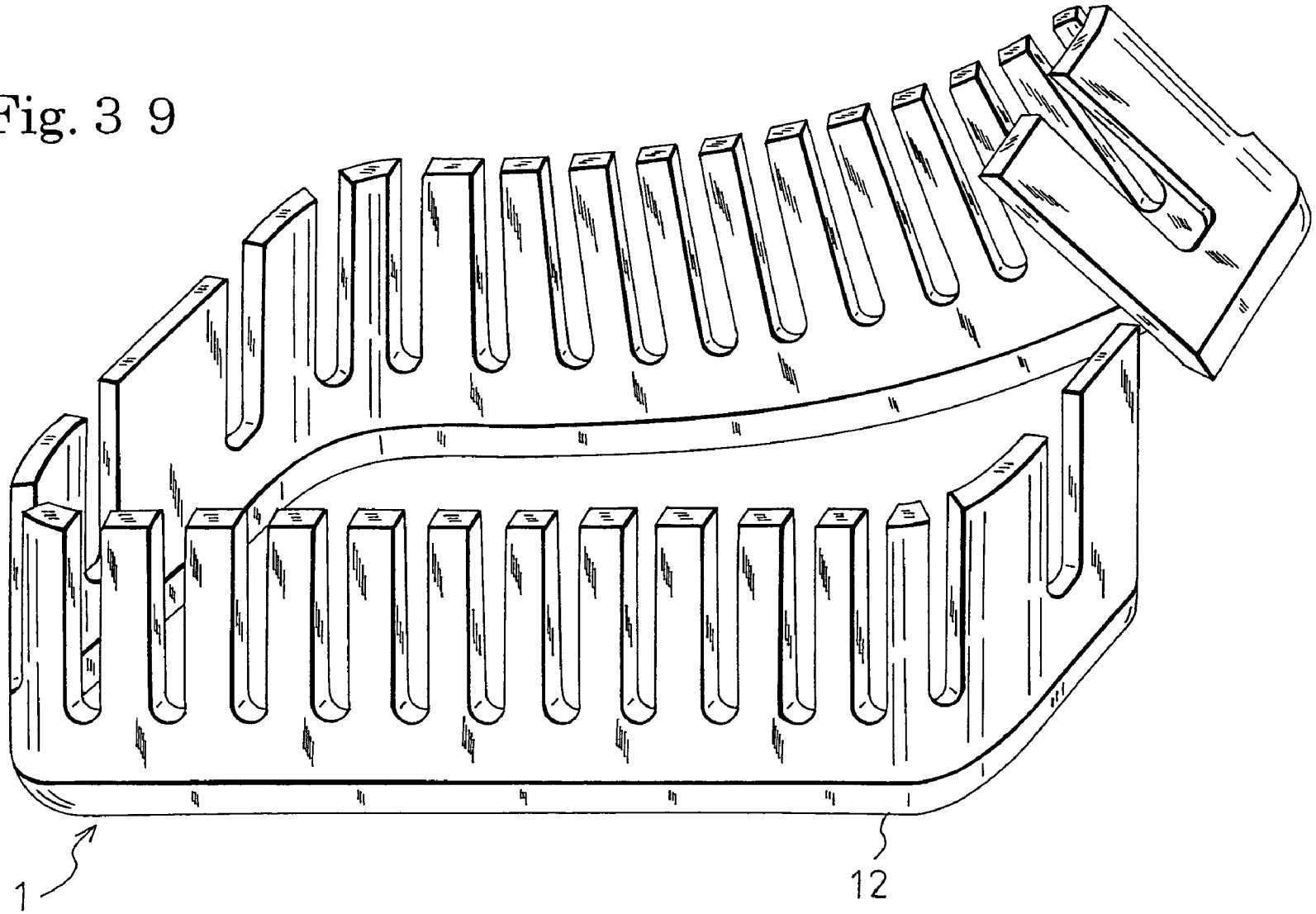
FIG. 39 is a perspective view showing the blade member during the width-direction bending process.
Figure 40:
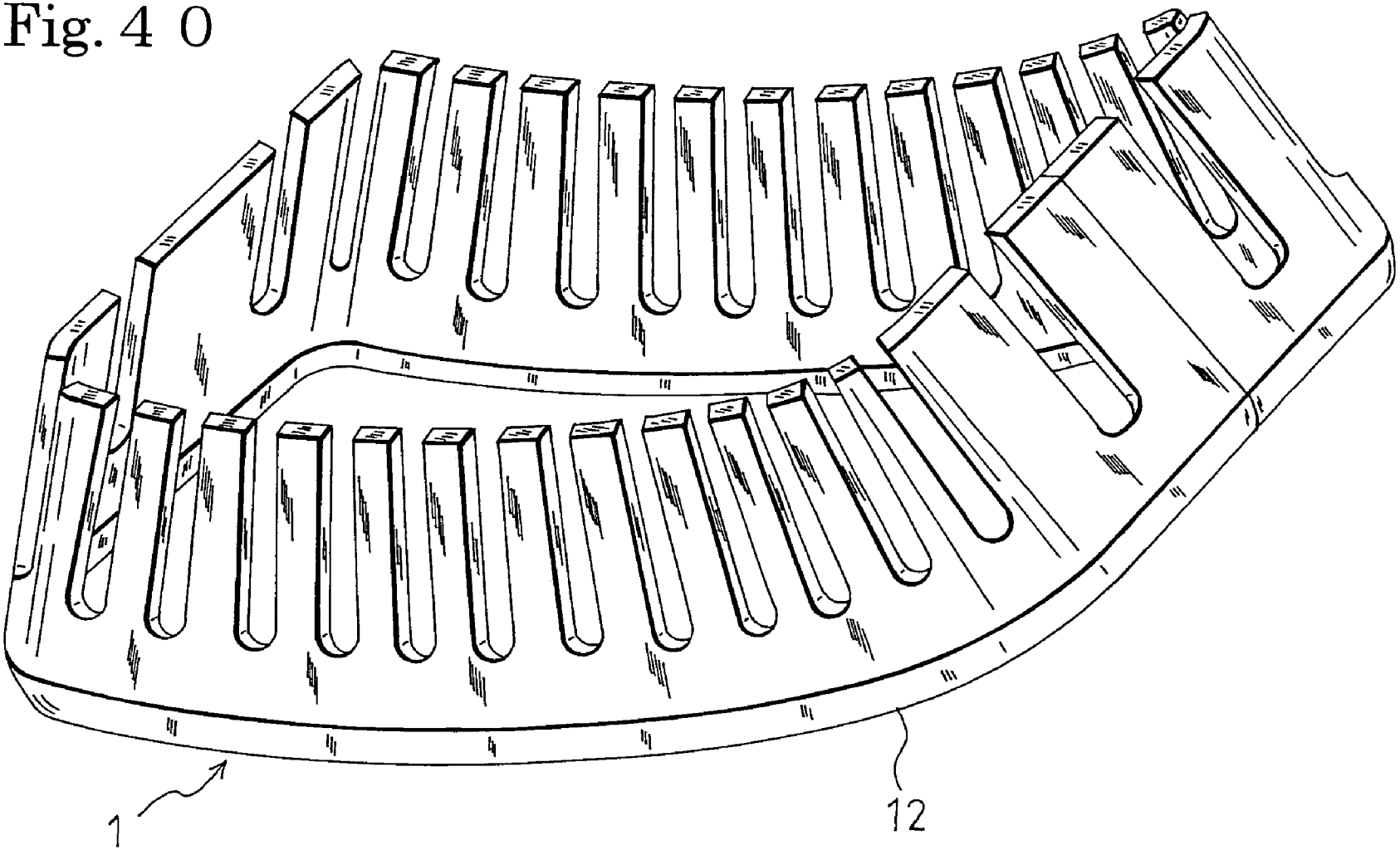
FIG. 40 is a perspective view showing the blade member after the width-direction bending process.

By the bending process in the width direction, as shown in, for example, FIG. 39, a range of the blade member 1 from one end portion to an intermediate portion can be bent in the width direction. It is a matter of course that the bending process in the width direction is enabled in either of the blade member 1 in which, as shown in FIG. 27, long slit-like notches 56 are formed in the other end edge in the width direction of the blade member 1 in the longitudinal direction of the blade member 1 at predetermined intervals, or that in which such notches are not formed as shown in FIG. 26. In FIG. 26, the blade edge 12 is formed into an undulated pattern in order that the blade member 1 to be bent can be used in formation of perforations in a work. Alternatively, the embodiment can be applied also to the blade member 1 in which the blade edge 12 is formed into a straight shape instead of an undulated pattern.

Next, the configuration of the thickness-direction bending die portion 10 will be described.

As shown in FIGS. 6 to 8, the thickness-direction bending die portion 10 is concentrically incorporated into the width-direction bending die portion 9. The thickness-direction bending die portion 10 is configured by a thickness-direction bending shaft 31, and a thickness-direction bending cylinder 32 which is fitted in a turning paired state onto the thickness-direction bending shaft 31.

As shown in FIGS. 18 to 22, the thickness-direction bending shaft 31 is formed into a cylindrical shape, and the rotary press cylinder 17 into which the pair of rotary press driving shaft 15 and rotary press driven shaft 16 are housed is inserted into the thickness-direction bending shaft 31 as shown in FIGS. 7 and 8. In other words, the thickness-direction bending shaft 31 is fitted concentrically and in a locked state onto the rotary press cylinder 17. Blade member passing holes 33, 33 which allow the blade member 1 to pass therethrough are penetratingly formed in the thickness-direction bending shaft 31 in a direction perpendicular to the axis of the thickness-direction bending shaft 31. The thickness-direction bending shaft 31 is fitted concentrically and in a locked state onto the rotary press cylinder 17 in a manner that the blade member passing holes 33, 33 communicate with the blade member passing holes 18, 18 of the rotary press cylinder 17.

In FIGS. 6 to 8, in the thickness-direction bending cylinder 32 which is fitted onto the thickness-direction bending shaft 31, first and second openings 34, 35 are formed at places which are symmetric about the axis. The first and second openings 34, 35 are formed so as to be opposed to the blade member passing holes 33, 33 of the thickness-direction bending shaft 31, and have a size larger than opening size of the blade member passing holes 33. A predetermined gap 36 (see FIG. 8) is disposed between the outer peripheral faces of outlet forming portions of the blade member passing holes 33 in the thickness-direction bending shaft 31, and the inner peripheral face of a first-opening forming portion in the thickness-direction bending cylinder 32. The thickness-direction bending shaft 31 and the thickness-direction bending cylinder 32 are relatively rotated, whereby the blade member 1 which is passed from the blade member passing hole 33 to the first opening 34 via the second opening 35 is bent in the thickness direction.

As shown in FIGS. 2 and 4, the thickness-direction bending cylinder 32 is forwardly or rearwardly rotated by a rotary driving mechanism 38 for the thickness-direction bending cylinder 32 and including a forward and rearward drive motor 37 for a thickness-direction bending process. In the rotary driving mechanism 38, the lower end of a driving shaft 41 in which a driving pinion 40 is fixed to the upper end is coupled via a coupling 42 to a rotation shaft 39 of the forward and rearward drive motor 37, a driven gear 43 is fitted and fixed onto the lower end of the thickness-direction bending cylinder 32, and the driven gear 43 meshes with the driving pinion 40. By driving of the forward and rearward drive motor 37, the thickness-direction bending cylinder 32 is forwardly or rearwardly rotated via the driving pinion 40 and the driven gear 43.

As shown in FIGS. 1 to 4, and 23, the thickness-direction bending die portion 10 comprising the thickness-direction bending shaft 31, the thickness-direction bending cylinder 32, and the thickness-direction bending-shaft rotary driving mechanism 38 is attached to a mounting table 44 which is separate from the chassis 2. In this case, the upper end of the thickness-direction bending shaft 31 is fixed to a cutaway portion 45 (see FIG. 23) of the mounting table 44 by a bent-shaft upper portion holder 46 (see FIG. 23), and the lower end is fitted and fixed into a mounting hole 47 (see FIG. 23) which is opened in the mounting table 44, by a bent-shaft lower portion holder 48 (see FIG. 23). As shown in FIGS. 1 and 4, the driving pinion 40 is placed on the mounting table 44, and the forward and rearward drive motor 37 is attached to the mounting table 44 in a suspended state.

The thickness-direction bending die portion 10 is disposed together with the mounting table 44 in a tiltable manner by a tilting driving mechanism 49 (see FIGS. 4 and 5) so that the tilting angle with respect to the blade member 1 can be changed in accordance with the curvature of the blade member 1 which is bent in the width direction by the width-direction bending die portion 9.

Figure 5:
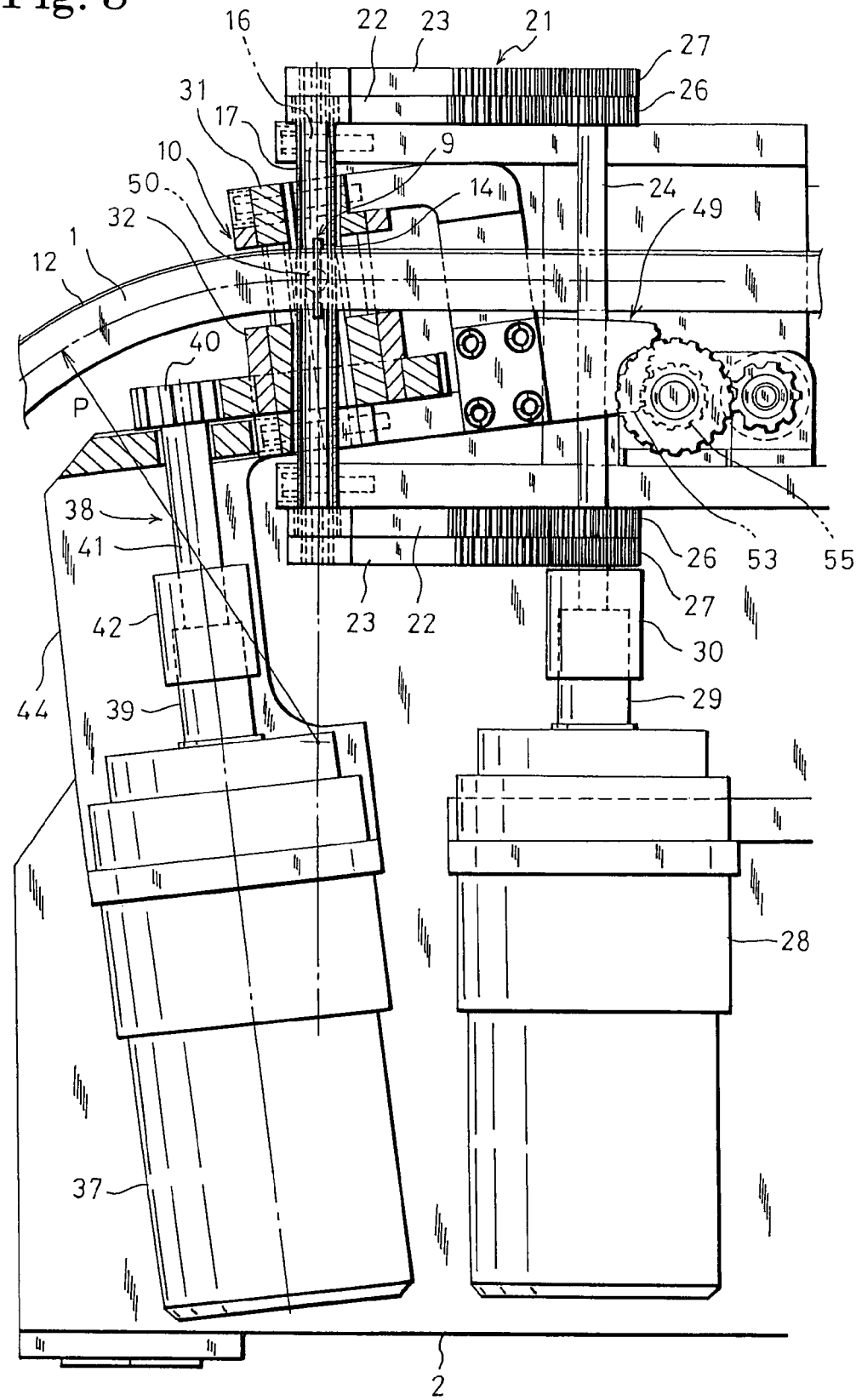
FIG. 5 is a side view showing a state where a thickness-direction bending die portion is tilted in correspondence to FIG. 4.

As shown in FIG. 17, therefore, a pair of support shafts 50 are disposed in an intermediate portion in the height direction of the outer periphery of the rotary press cylinder 17 of the width-direction bending die portion 9, so as to be projected in a direction perpendicular to the blade member passing holes 18. As a result, as shown in FIGS. 5 and 7, the thickness-direction bending shaft 31 of the thickness-direction bending die portion 10 is fitted onto the rotary press cylinder 17 so as to be swingable about the support shafts 50. As shown in FIGS. 7 and 19, the internal shape of the thickness-direction bending shaft 31 is formed into a shape in which, when the thickness-direction bending shaft 31 is swung about the support shafts 50 outside the rotary press cylinder 17, the inside of the thickness-direction bending shaft 31 does not interfere with the side face of the rotary press cylinder 17 to impede the swing operation. In the internal shape of the thickness-direction bending shaft 31, namely, as shown in FIGS. 7 and 19, a portion 51*a* which is above the support-shaft receiving portion 51 is formed in a upward-flared shape so as to be larger than the outer diameter of the rotary press cylinder 17, and a portion 51*b* which is below a support-shaft receiving portion 51 is formed in a downward-flared shape so as to be larger than the outer diameter of the rotary press cylinder 17. In the inner face of the thickness-direction bending shaft 31, grooves 52, 52 which are downward opened are disposed at places which are symmetric about the axis of the thickness-direction bending shaft 31 and in parallel to the axis, and the support-shaft receiving portions 51 are disposed on the upper ends of the grooves 52, 52. When the thickness-direction bending shaft 31 is to be incorporated into the rotary press cylinder 17, the rotary press cylinder 17 comprising the support shafts 50, 50 is inserted from the lower side into the thickness-direction bending shaft 31 so that the support shafts 50, 50 are inserted along the grooves 52, 52.

In the tilting driving mechanism 49 which tilts the thickness-direction bending die portion 10, as shown in FIGS. 3 and 4, a pair of tilting drive gears 53, 53 are attached to the mounting table 44, and a forward and rearward drive motor 54, and a pair of transmission gears 55, 55 which are rotated by the forward and rearward drive motor 54 via intermediate transmission gears 57 are attached onto the working table 3 of the chassis 2. The transmission gears 55, 55 mesh with the tilting drive gears 53, 53. According to the configuration, by driving of the forward and rearward drive motor 54, the thickness-direction bending die portion 10 is swung together with the mounting table 44 about the support shafts 50 via the transmission gears 55 and the drive gears 53, and the tilting angle with respect to the blade member can be changed.

Next, a method of bending the blade member 1 in the thickness direction by using the thus configured thickness-direction bending die portion 10 will be described with reference to FIGS. 29A and 29*b*.

In an initial stage of the bending process, as shown in FIG. 29A, the first and second openings 34, 35 of the thickness-direction bending cylinder 32 are opposed to outlet and inlet opening ends of the blade member passing hole 33 of the thickness-direction bending shaft 31. In this state, the blade member 1 is fed between the rotary press claws 13, 14 of the width-direction bending die portion 9 through the second opening 35 of the thickness-direction bending cylinder 32, and the inlet opening end of the blade member passing hole 33, and then bent in the width direction as described above.

When a tip end portion of the blade member 1 which has been bent in the width direction in the width-direction bending die portion 9 is projected by a predetermined projection amount from the outlet opening end of the blade member passing hole 33, the blade member feeding operation by the blade member feeding portion 4 is stopped. In this state, the forward and rearward drive motor 37 of the bending-shaft rotary driving mechanism 38 is forwardly driven by a predetermined angle, and, as shown in FIG. 29B, the thickness-direction bending cylinder 32 is relatively rotated in one direction (counterclockwise direction) J with respect the thickness-direction bending shaft 31. When the rotation angle reaches a preset angle, the forward rotation of the forward and rearward drive motor 37 is stopped. As a result, as shown in FIG. 29B, the blade member 1 is bent in the thickness direction by a predetermined bending angle. Thereafter, the forward and rearward drive motor 37 is rearwardly rotated, and the thickness-direction bending cylinder 32 returns to its initial position to be stopped. The above is a thickness-direction bending step. In a procedure similar to that of the above-described bending step, thereafter, the blade member is bent in the thickness direction.

When the blade member 1 is to be bent in a thickness direction opposite to the above-described thickness direction, the forward and rearward drive motor 37 is rearwardly driven as shown in FIG. 30, and the thickness-direction bending cylinder 32 is relatively rotated in the other direction (clockwise direction) K with respect the thickness-direction bending shaft 31.

When the thickness-direction bending process is repeated while the blade member 1 is intermittently fed by a small pitch, the blade member can be bent in the thickness direction into arcuate curves P1, P2, P3 as shown in FIG. 31.

Figure 38:
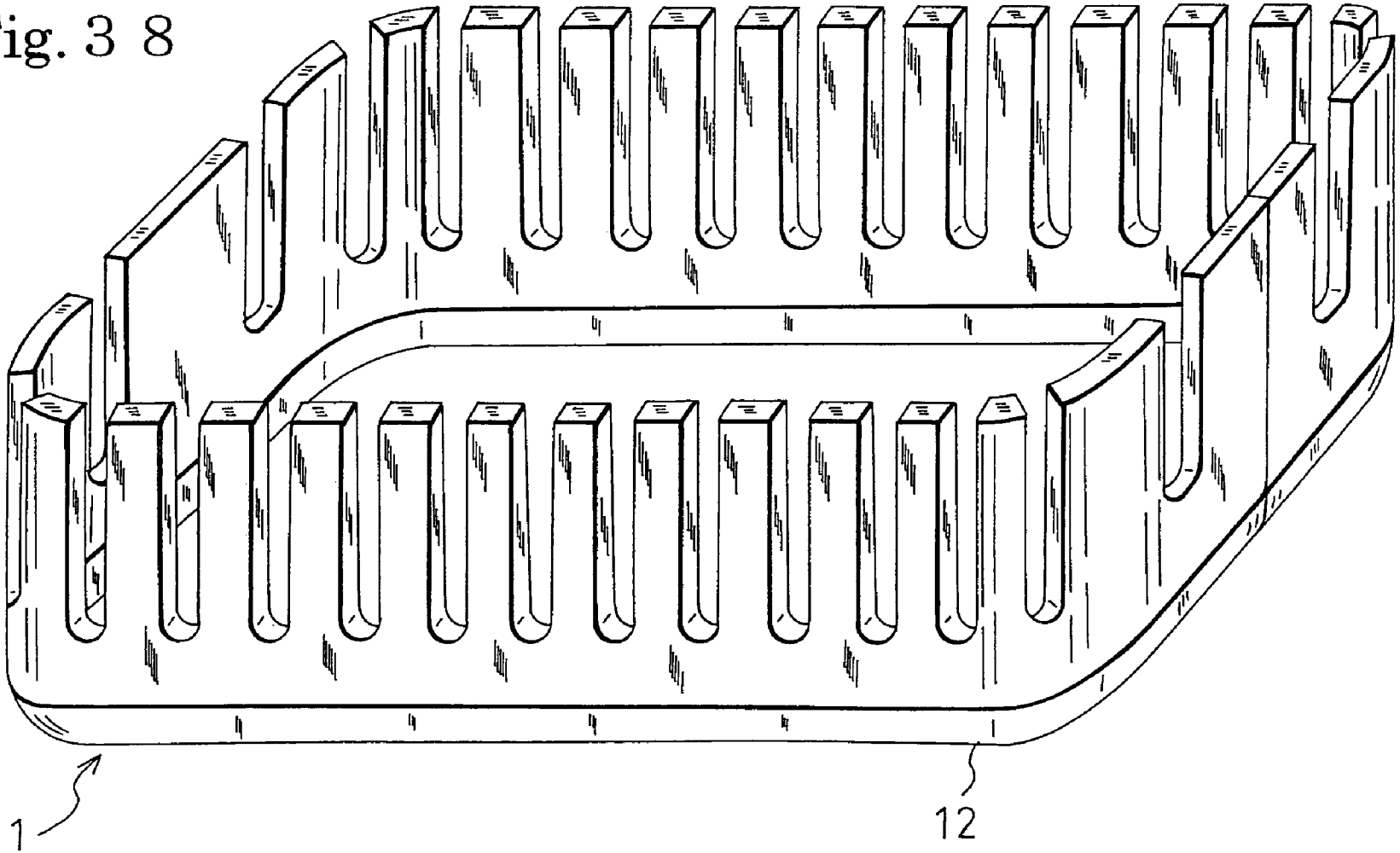
FIG. 38 is a perspective view showing a blade member before the width-direction bending process.

By the thickness-direction bending process, as shown in FIG. 38, the blade member 1 can be bent into a substantially rectangular shape in a plan view.

In the process of bending a blade member in the thickness direction, in advance of the process, the thickness-direction bending die portion 10 is swung about the support shafts 50 by driving of the forward and rearward drive motor 54 of the tilting driving mechanism 49 to set the tilting angle with respect to the blade member 1 to a predetermined angle, whereby, as shown in FIG. 5, the thickness-direction bending die portion 10 can be tilted to the predetermined angle so as to coincide with the curvature ($1/\rho$) of the blade member 1 which has been bent in the width direction in the width-direction bending die portion 9. In FIG. 5, $\rho$ indicates the distance from the center O of a partial arc of the blade member 1 which has been bent in the width direction, to the center line in the width direction of the blade member 1, i.e., the radius of curvature.

Figure 28:
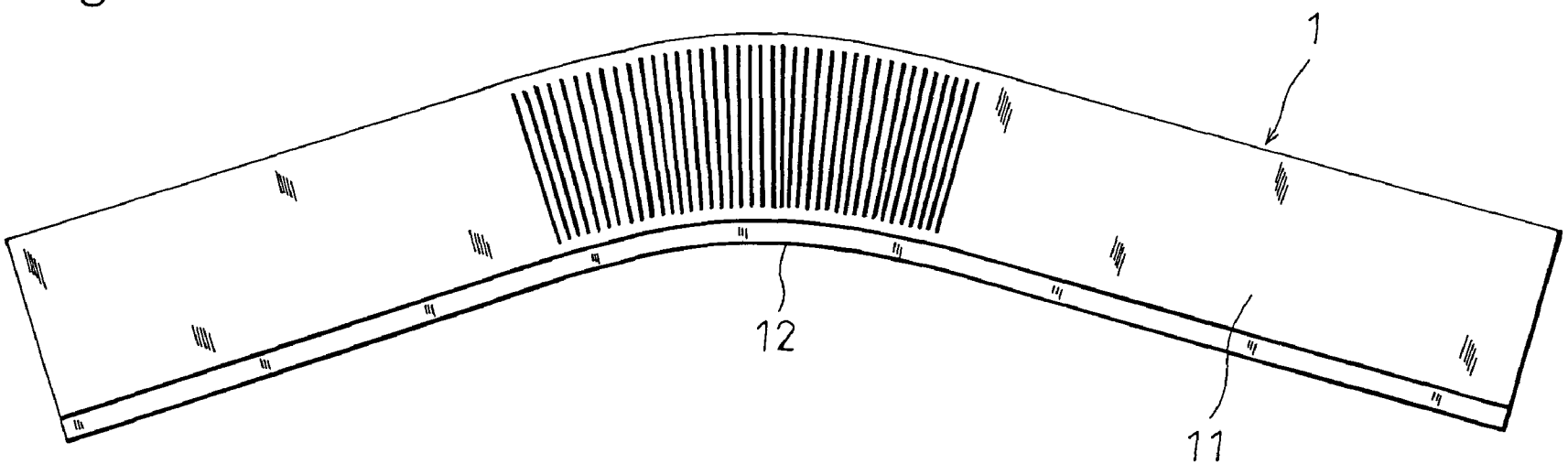
FIG. 28 is a side view of a state where a blade member in a further embodiment is bent in the width direction.
Figure 3:
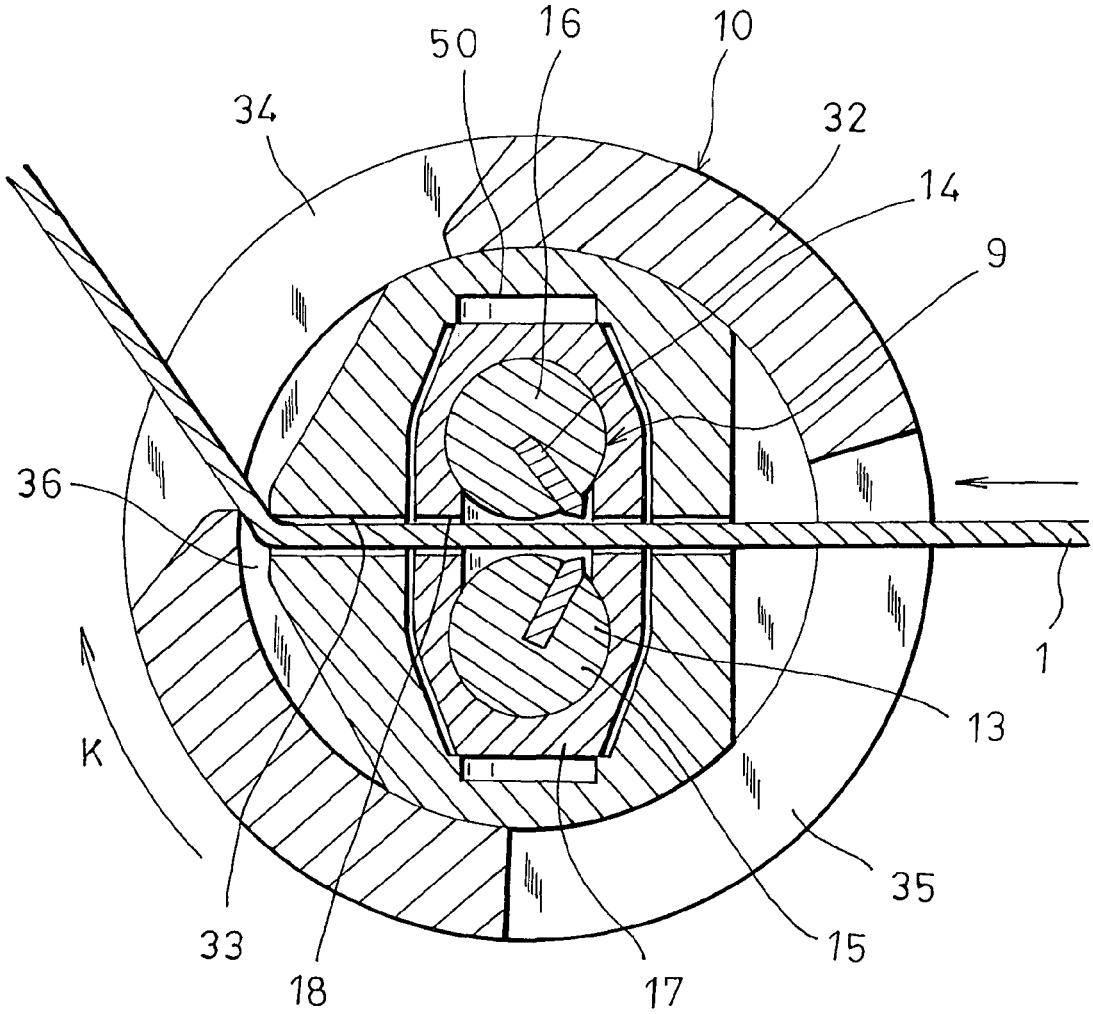
Figure 3:
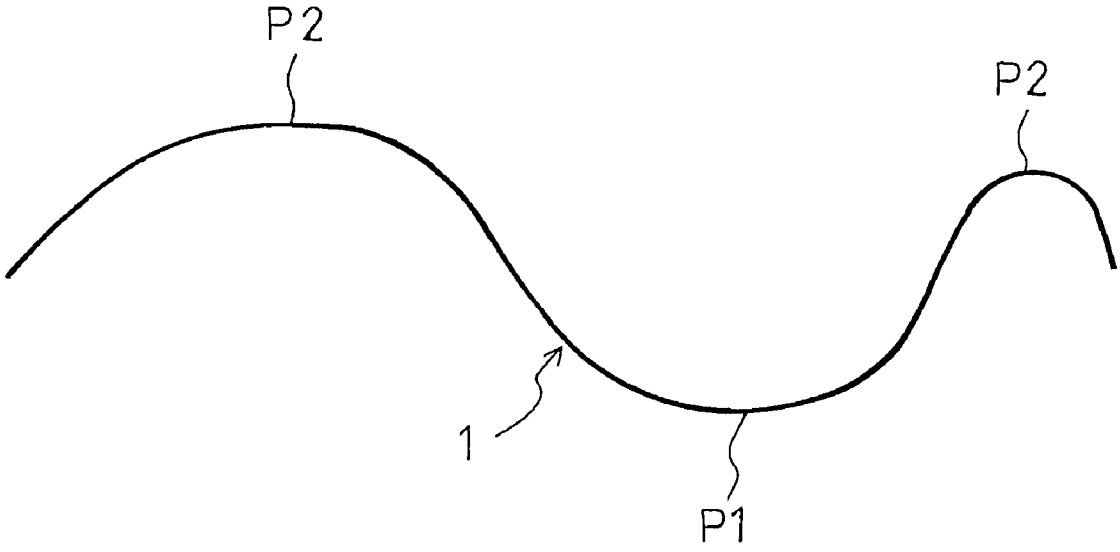
Figure 3:
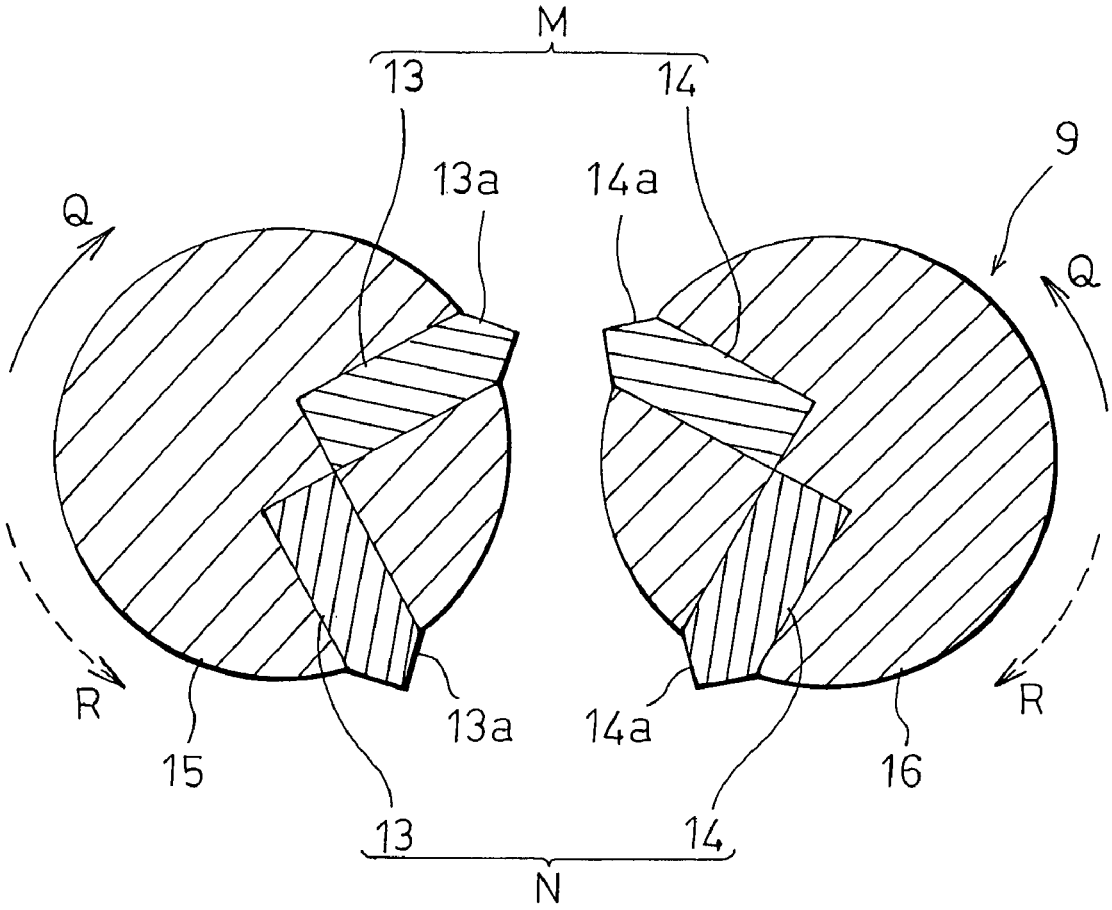

In the embodiment, as the width-direction bending die portion 9, the configuration in which, as shown in FIGS. 24A and 24B, the tip end edges 13*a*, 14*a* of the pair of rotary press claws 13, 14 are tilted so that the compression amount of the blade member 1 is gradually increased as advancing toward one end edge (the blade edge 12) in the width direction of the blade member is employed. Alternatively, a configuration in which, as shown in FIGS. 25A and 25B, the tip end edges are tilted so that the compression amount is gradually increased as advancing toward the other end edge in the width direction of the blade member 1 may be employed. When the blade member 1 is bent in the width direction by the rotary press claws 13, 14 in which the tip end edges are tilted so that the compression amount is gradually increased as advancing toward the other end edge in the width direction of the blade member 1, the compressed portion can be worked into a curved shape in which the other end edge in the width direction of the blade member 1 is swollen in the width direction as shown in FIG. 28.

In the width-direction bending die portion 9, the pair of rotary press claws 13, 14 in which, as shown in FIGS. 24A and 24B, the tip end edges 13*a*, 14*a* are tilted so that the compression amount is gradually increased as advancing toward one end edge (the blade edge 12) in the width direction of the blade member 1, and the pair of rotary press claws 13, 14 in which, as shown in FIGS. 25A and 25B, the tip end edges 13*a*, 14*a* are tilted so that the compression amount is gradually increased as advancing toward the other end edge in the width direction of the blade member 1 may be attached to the same rotary press driving shaft 15 and rotary press driven shaft 16 as shown in FIG. 32. In this case, the former rotary press claws 13, 14 (indicated by the letter M in FIG. 32) are caused to approach each other by relative forward rotation (in the direction of the arrow Q in FIG. 32) of the rotary press driving shaft 15 and the rotary press driven shaft 16, and, by contrast, the latter rotary press claws 13, 14 (indicated by the letter N in FIG. 32) are caused to approach each other by relative rearward rotation (in the direction of the arrow R in FIG. 32) of the rotary press driving shaft 15 and the rotary press driven shaft 16.

Figure 33:
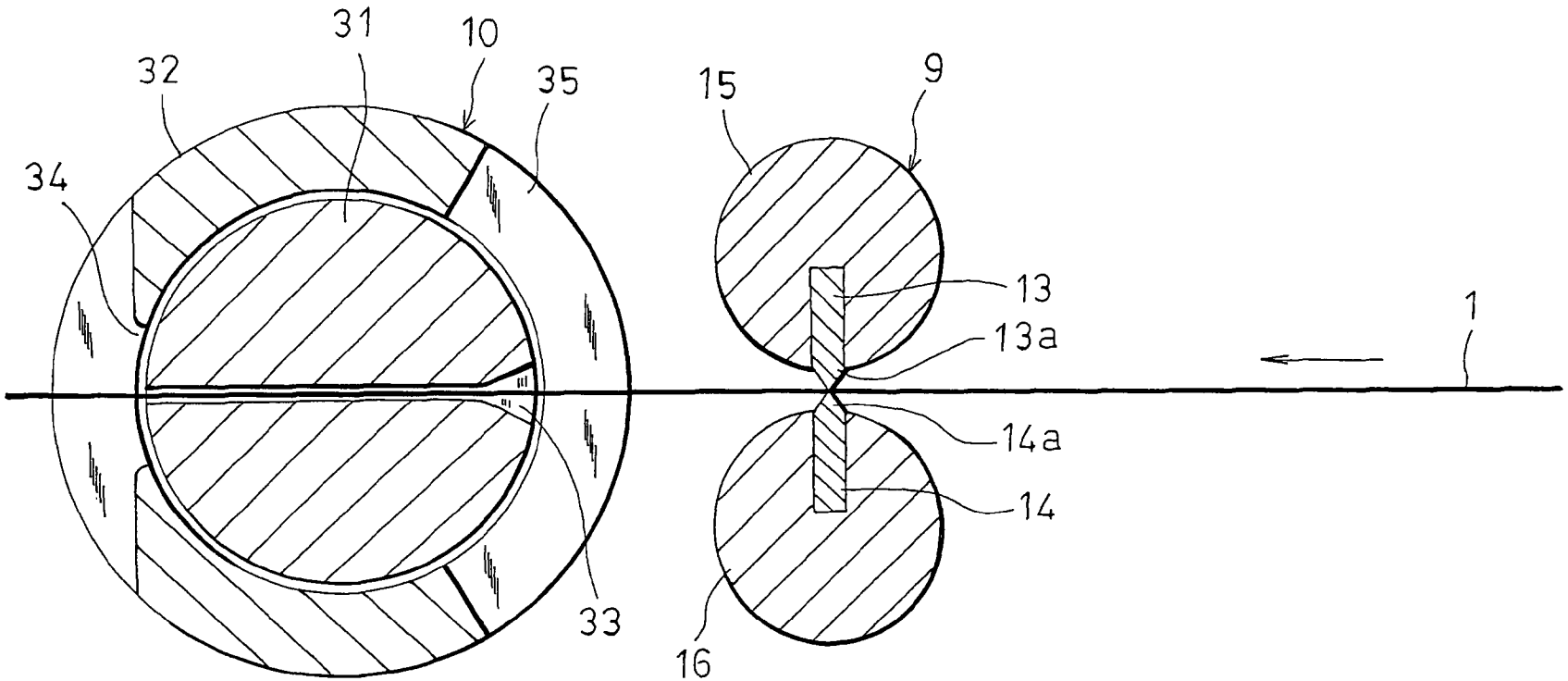
FIG. 33 is a transverse sectional plan view of a blade member bending apparatus of the other embodiment.
Figure 3:
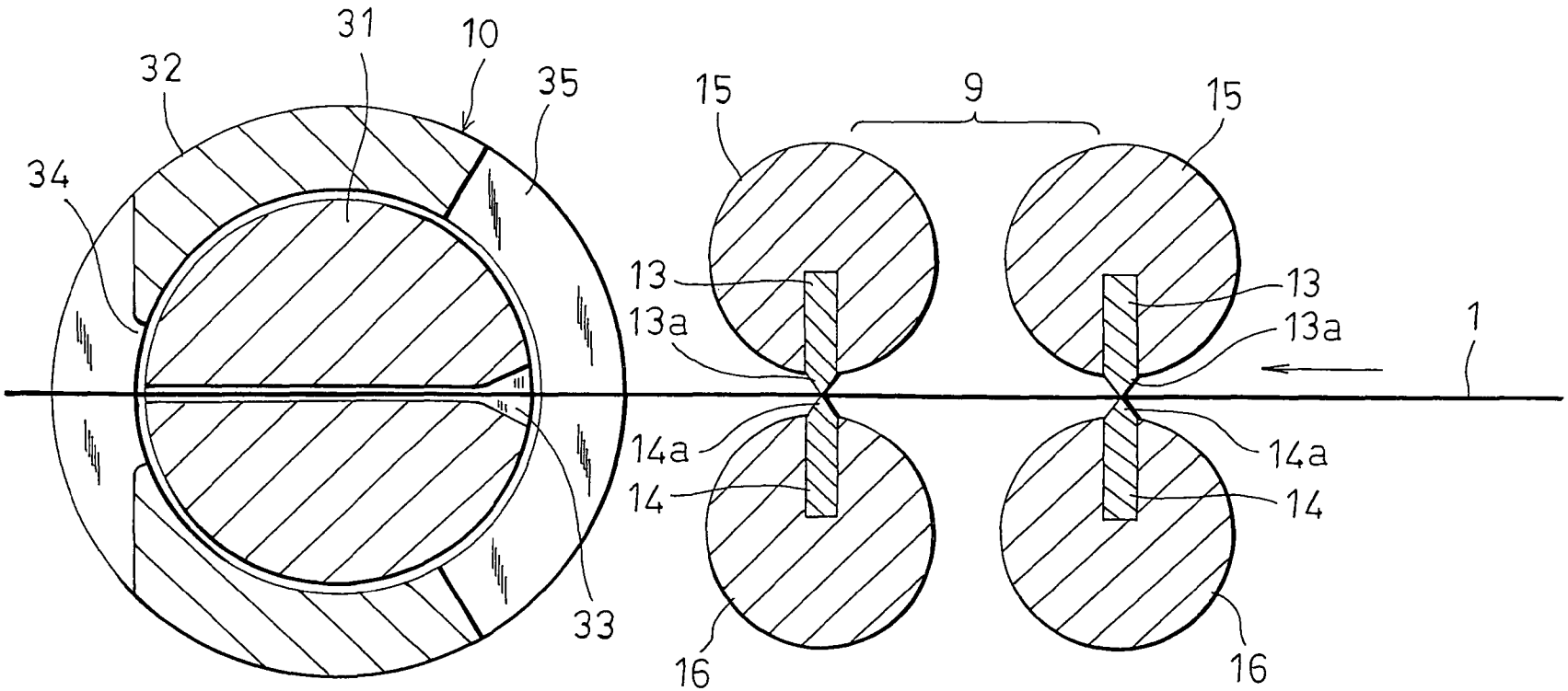

In the embodiment, the thickness-direction bending die portion 10 is concentrically incorporated into the width-direction bending die portion 9 so that the whole bending apparatus can be compacted and miniaturized while allowing the blade member 1 to be succeedingly bent in the thickness direction after being bent in the width direction. Alternatively, as shown in FIG. 33, the thickness-direction bending die portion 10 may be juxtaposed with a downstream side of the width-direction bending die portion 9 in the blade member feeding direction. Also in this configuration, after the blade member 1 is bent in the width direction, the bending process in the thickness direction can be succeedingly performed.

In the width-direction bending die portion 9, as shown in FIG. 34, the rotary press driving shaft 15 and rotary press driven shaft 16 to which the pair of rotary press claws 13, 14 that are tilted so that the compression amount is gradually increased as advancing toward one end edge (the blade edge 12) in the width direction of the blade member 1 are attached, and the rotary press driving shaft 15 and rotary press driven shaft 16 to which the pair of rotary press claws 13, 14 that are tilted so that the compression amount is gradually increased as advancing toward the other end edge in the width direction of the blade member 1 are attached may be juxtaposed in the blade member feeding direction.

Figure 35:
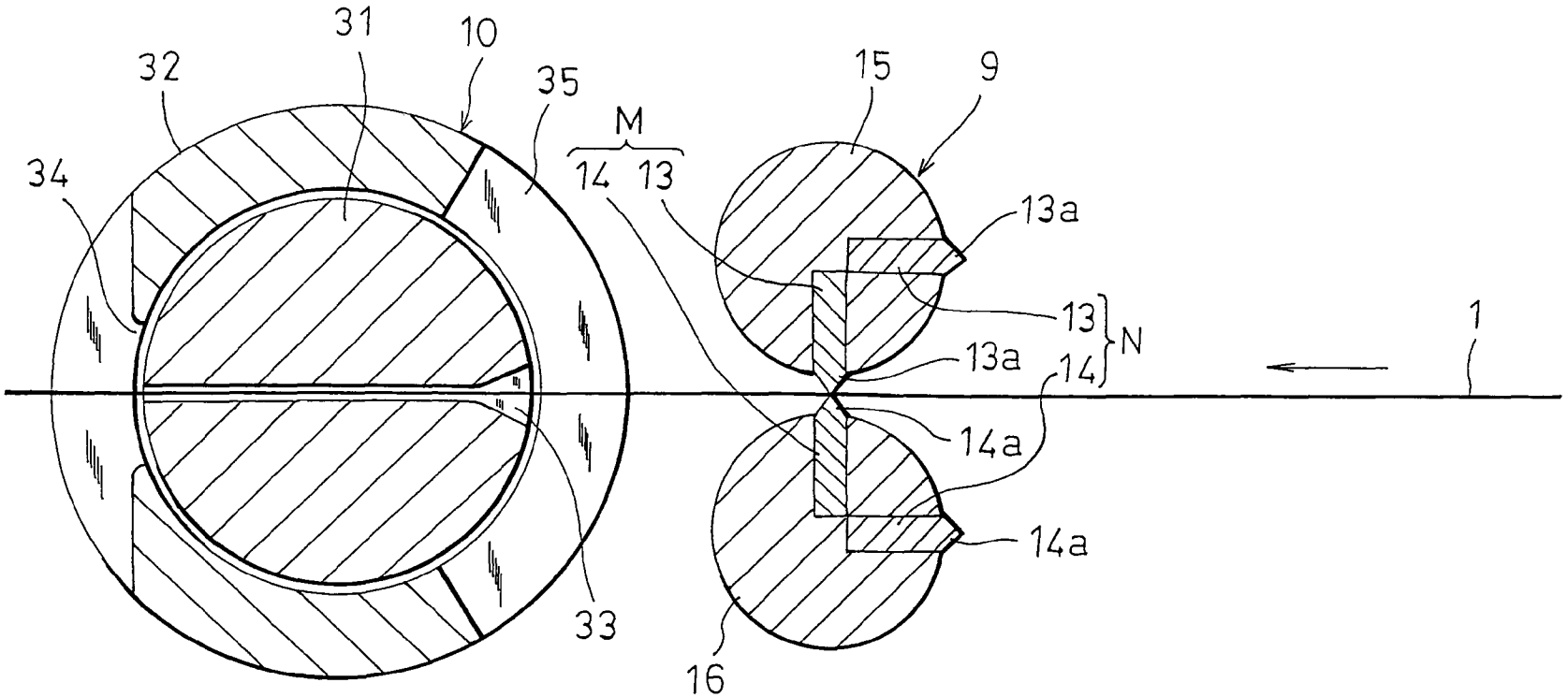
FIG. 35 is a transverse sectional plan view of a blade member bending apparatus of a still further embodiment.
Figure 3:
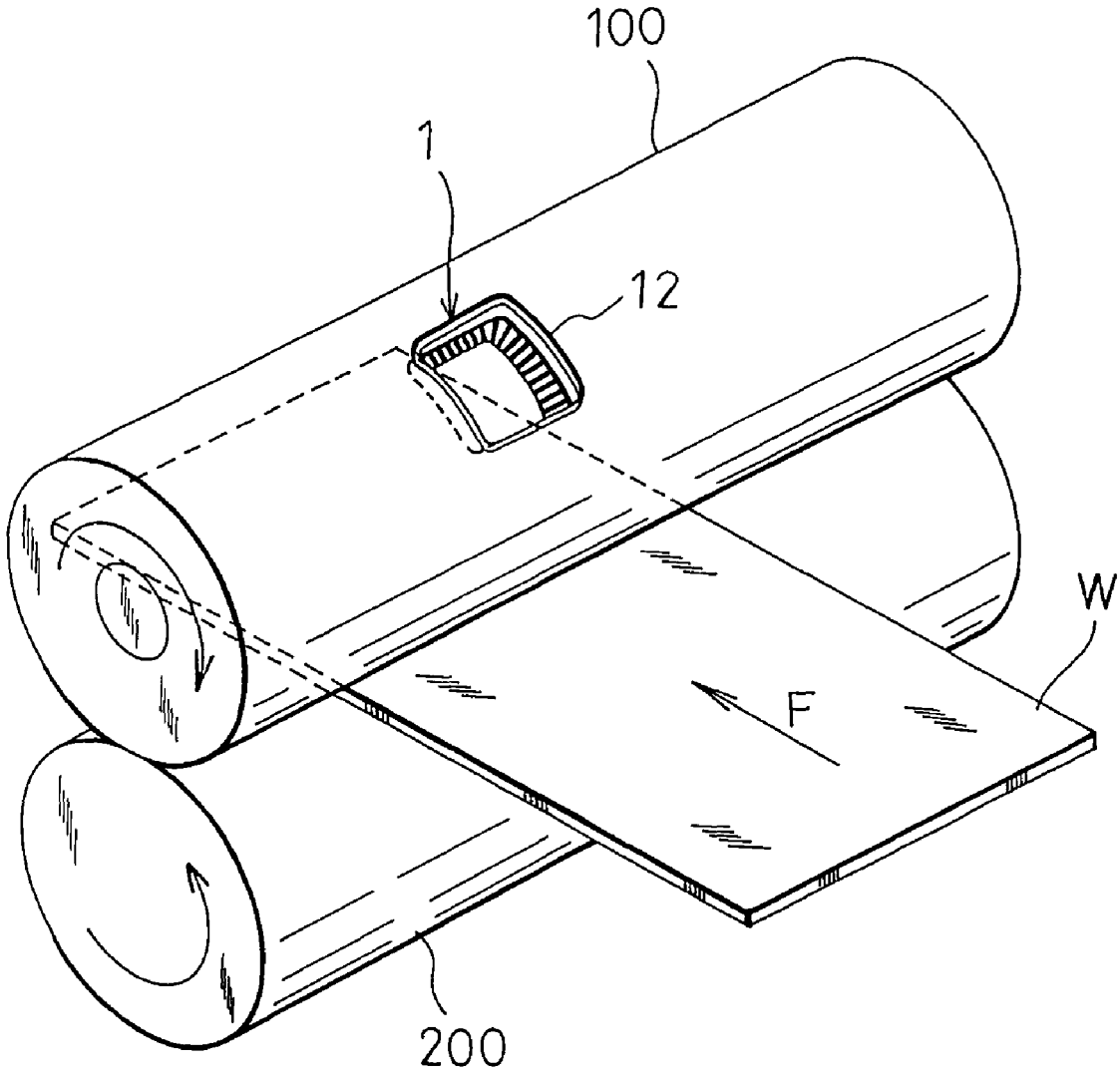
Figure 3:
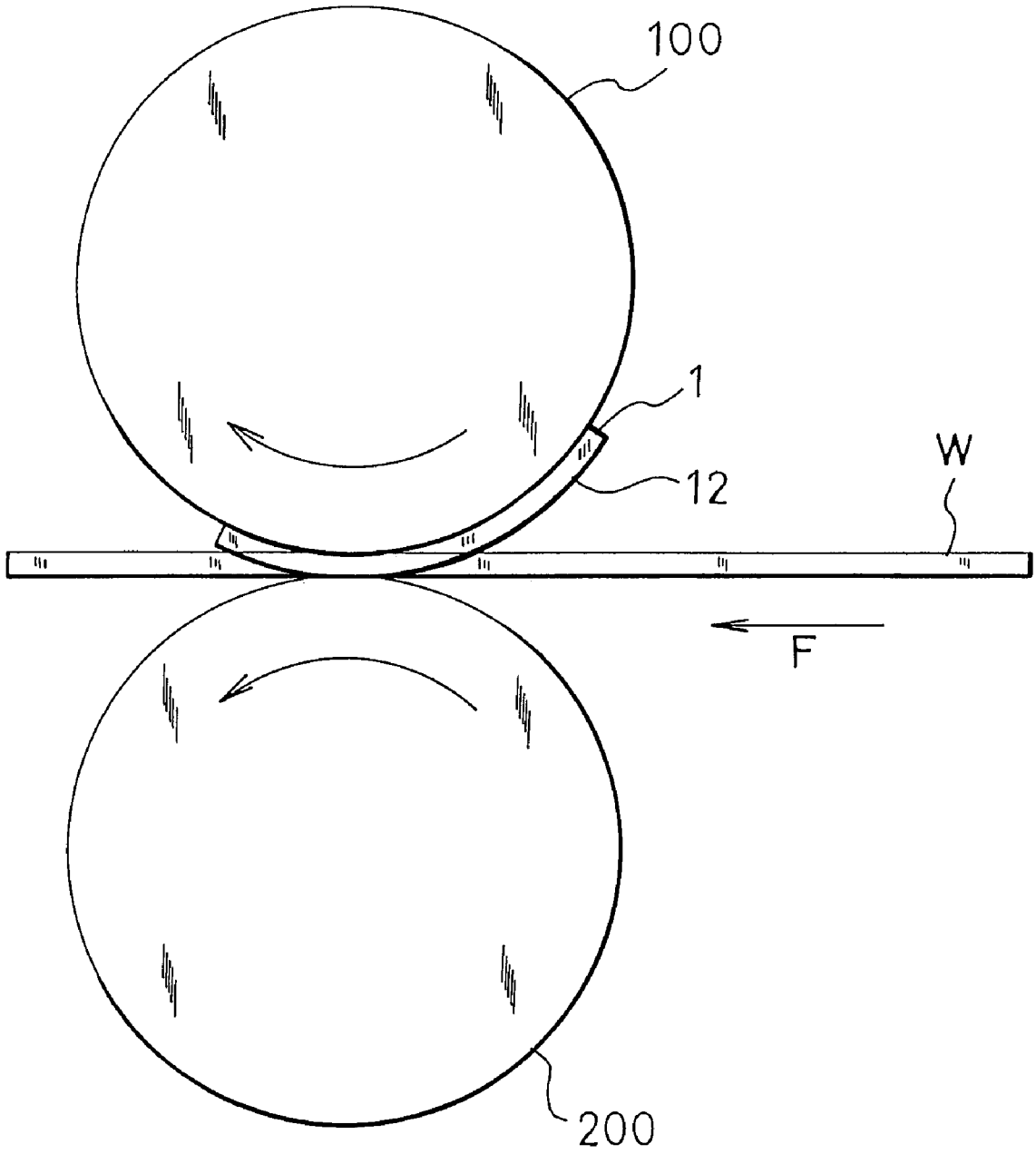

As shown in FIG. 35, the width-direction bending die portion 9 which is configured by attaching the pair of rotary press claws 13, 14 (indicated by the letter M in FIG. 35) that are tilted so that the compression amount is gradually increased as advancing toward one end edge (the blade edge 12) in the width direction of the blade member 1, and the pair of rotary press claws 13, 14 (indicated by the letter N in FIG. 35) that are tilted so that the compression amount is gradually increased as advancing toward the other end edge in the width direction of the blade member 1, to the same rotary press driving shaft 15 and the rotary press driven shaft 16 may be juxtaposed with the upstream side of the thickness-direction bending die portion 10 in the blade member feeding direction.

In the embodiment, the operation timings and amounts of the blade member feeding motor 8, the forward and rearward drive motor 28 for the width-direction bending process, the forward and rearward drive motor 37 for the thickness-direction bending process, and the forward and rearward drive motor 54 of the tilting driving mechanism 49 are controlled by a computer. A program corresponding to the final bent shape of the blade member 1 is prepared, and the computer supplies a signal based on a command of the program, to the motors.

What is claimed is:

1. A method of bending a strip-like blade member having a blade edge in one end edge in a width direction, with a blade member bending apparatus including: a working die portion; a pair of rotary press claws disposed in the working die portion; a thickness-direction bending shaft a thickness-direction bending cylinder which is fitted in a turning paired state onto the thickness-direction bending shaft a strip-like blade member passing hole which is penetratingly formed in the thickness-direction bending shaft in a direction perpendicular to an axis of the thickness-direction bending shaft, and which allows the strip-like blade member to pass therethrough; and first and second openings which are opposed respectively to outlet and inlet opening ends of the strip-like blade member passing hole, comprising the steps of:

intermittently feeding the strip-like blade member to the working die portion performing a bending process by the working die portion during stoppage of said intermittently feeding of the strip-like blade member, said bending process includes: a width-direction bending step for bending the strip-like blade member in a width direction; and a thickness-direction bending step for bending the strip-like blade member in a thickness direction;

clamping the strip-like blade member in said width-direction bending step by the pair of rotary press claws disposed in the working die portion, from both sides in the thickness direction to be compressed in the thickness direction, whereby the compressed portion of the strip-like blade member is extended in a longitudinal direction of the strip-like blade member, and the strip-like blade member is bent in the width direction;

disposing a predetermined gap between an outer peripheral face of an outlet forming portion of the strip-like blade member passing hole in the thickness-direction bending shaft, and an inner peripheral face of a first-opening forming portion in the thickness-direction bending cylinder;

relatively rotating the thickness-direction bending shaft and the thickness-direction bending cylinder, whereby the strip-like blade member which is passed from the strip-like blade member passing hole to the first opening via the second opening is bent in the thickness direction;

said width-direction bending process is performed by a configuration where said pair of rotary press claws are attached to a pair of rotary press driving shaft and rotary press driven shaft which are opposed in a vertical posture to each other on both sides across said blade member, in a manner that said rotary press claws are rotatable in opposite directions, so that tip end edges of said claws are projected to outsides of said shafts, respectively, and said pair of rotary press driving shaft and rotary press driven shaft are relatively rotated to cause said rotary press claws to approach each other;

said thickness-direction bending process is performed by a configuration where said thickness-direction bending shaft is formed into a cylindrical shape and fixed, said pair of rotary press driving shaft and rotary press driven shaft are housed in said thickness-direction bending shaft, a rotary press cylinder having blade member passing holes is inserted in a manner that said blade member passing holes communicate with said blade member passing hole of said thickness—direction bending shaft, and said thickness—direction bending cylinder which is fitted in a turning paired state onto said thickness-direction bending shaft is rotated; and said thickness-direction ending process is performed by tilting said thickness-direction bending shaft and said thickness-direction bending cylinder with respect to said blade member so as to coincide with a curvature of said blade member which has been bent in the width direction.

2. The method of bending a strip-like blade member according to claim 1, wherein in said width-direction bending step for said blade member, a compression amount in the compressed portion of the blade member is gradually increased as advancing toward one end edge in the width direction of the blade member.

3. The method of bending a strip-like blade member according to claim 1, wherein:

in said width-direction bending step for said blade member, a compression amount in the compressed portion of said blade member is gradually increased as advancing toward another end edge in the width direction of said blade member.

4. The method of bending a strip-like blade member according to claim 1, wherein:

said width-direction bending step for said blade member is performed by using rotary press claws which have a V-like section shape, and which comprise a tip end edge extending along the width direction of said blade member.

5. The method of bending a strip-like blade member according to claim 2, wherein:

said width-direction bending step for said blade member is performed by using rotary press claws which have a V-like section shape, and which comprise a tip end edge extending along the width direction of said blade member.

6. The method of bending a strip-like blade member according to claim 3, wherein:

said width-direction bending step for said blade member is performed by using rotary press claws which have a V-like section shape, and which comprise a tip end edge extending along the width direction of said blade member.

7. The method of bending a strip-like blade member according to claim 4, wherein:

said pair of rotary press claws are placed on both sides across said blade member in a manner that said rotary press claws are relatively rotatable in opposite directions, and said rotary press claws are caused to approach each other by relative rotation, thereby performing said width-direction bending process.

8. The method of bending a strip-like blade member according to claim 5, wherein:

said pair of rotary press claws are placed on both sides across said blade member in a manner that said rotary press claws are relatively rotatable in opposite directions, and said rotary press claws are caused to approach each other by relative rotation, thereby performing said width-direction bending process.

9. The method of bending a strip-like blade member according to claim 6, wherein:

said pair of rotary press claws are placed on both sides across said blade member in a manner that said rotary press claws are relatively rotatable in opposite directions, and said rotary press claws are caused to approach each other by relative rotation, thereby performing said width-direction bending process.

10. The method of bending a strip-like blade member according to claim 5, wherein:

said width-direction bending process is performed by using said rotary press claws in which said tip end edge is tilted with respect to a side face of said blade member that is opposed to said tip end edge.

11. The method of bending a strip-like blade member according to claim 6, wherein:

said width-direction bending process is performed by using said rotary press claws in which said tip end edge is tilted with respect to a side face of said blade member that is opposed to said tip end edge.

12. An apparatus for bending a strip-like blade member having a blade edge in one end edge in a width direction, comprising:

a working die portion, which performs a bending process during stoppage of a feeding process, wherein:

said working die portion comprises: a width-direction bending die portion which bends the blade member in a width direction; and a thickness-direction bending die portion which, after the width-direction bending process, bends the blade member in a thickness direction;

said width-direction bending die portion comprises a pair of rotary press claws which are placed on both sides across the blade member in a manner that said rotary press claws are relatively rotatable in opposite directions, and is configured so that said rotary press claws are provided with tip end edges extending along the width direction of said blade member;

said rotary press claws are relatively rotated in opposite directions to approach each other to compress the blade member between said tip end edges from both sides of the thickness direction to compress the blade member in the thickness direction, whereby the compressed portion is extended in a longitudinal direction of the blade member and the blade member is bent in the width direction;

said thickness-direction bending die portion is configured by: a thickness-direction bending shaft; and a thickness-direction bending cylinder which is fitted in a turning paired state onto said thickness-direction bending shaft, a blade member passing hole which allows the blade member to pass therethrough is penetratingly formed in said thickness-direction bending shaft in a direction perpendicular to an axis of said thickness-direction bending shaft, first and second openings which are opposed to outlet and inlet opening ends of said blade member passing hole are formed in said thickness-direction bending cylinder;

a predetermined gap is disposed between an outer peripheral face of an outlet forming portion of said blade member passing hole in said thickness-direction bending shaft, and an inner peripheral face of a first-opening forming portion in said thickness-direction bending cylinder, and said thickness-direction bending shaft and said thickness-direction bending cylinder are relatively rotated, whereby the blade member which is passed from said blade member passing hole to said first opening via said second opening is bent; and said thickness-direction bending die portion is disposed to be tiltable so that a tilting angle with respect to the blade member is changeable in accordance with a curvature of the blade member which has been bent in the width direction by said width-direction bending die portion.

13. The apparatus for bending a strip-like blade member according to claim 12, wherein:

the portion of the blade member to be compressed is pressed to be compressed, in a state where tip end edges of said pair of rotary press claws are tilted with respect to side faces of said blade member which are opposed to said tip end edges, respectively.

14. The apparatus for bending a strip-like blade member according to claim 13, wherein:

said tip end edges of said pair of rotary press claws are tilted so that a compression amount with respect to the blade member is gradually increased as advancing toward one end edge in the width direction of said blade member.

15. The apparatus for bending a strip-like blade member according to claim 13, wherein:

said tip end edges of said pair of rotary press claws are tilted so that a compression amount with respect to the blade member is gradually increased as advancing toward another end edge in the width direction of said blade member.

16. The apparatus for bending a strip-like blade member according to claim 12, wherein:

said width-direction bending die portion comprises: a pair of rotary press claws which are tilted so that a compression amount with respect to said blade member is gradually increased as advancing toward one end edge in the width direction of said blade member; and a pair of rotary press claws which are tilted so that a compression amount with respect to said blade member is gradually increased as advancing toward another end edge in the width direction of said blade member.

17. The apparatus for bending a strip-like blade member according to claim 12, wherein:

said pair of rotary press claws are attached to a pair of rotary press driving shaft and rotary press driven shaft which are placed on both sides across said blade member in a manner that said rotary press claws are rotatable in opposite directions, so that tip end edges are projected to outsides of said shafts, respectively.

18. The apparatus for bending a strip-like blade member according to claim 17, wherein:

said thickness-direction bending die portion is concentrically incorporated into said width-direction bending die portion.

19. The apparatus for bending a strip-like blade member according to claim 18, wherein:

said thickness-direction bending shaft is formed into a cylindrical shape, said pair of rotary press driving shaft and rotary press driven shaft are housed in said thickness-direction bending shaft, and a rotary press cylinder having blade member passing holes is inserted in a manner that said blade member passing holes communicate with said blade member passing hole of said thickness-direction bending shaft.

20. The apparatus for bending a strip-like blade member according to claim 19, wherein:

said thickness-direction bending shaft is fixed, and said thickness-direction bending cylinder is rotatable.

21. The apparatus for bending a strip-like, blade member according to claim 12, wherein:

said thickness-direction bending die portion is juxtaposed with a downstream side of said width-direction bending die portion in a blade member feeding direction.

22. The apparatus for bending a strip-like blade member according to claim 12, wherein:

said width-direction bending die portion is configured in a manner that a pair of rotary press claws which are tilted so that a compression amount with respect to said blade member is gradually increased as advancing toward one end edge in the width direction of said blade member, and a pair of rotary press claws which are tilted so that a compression amount with respect to said blade member is gradually increased as advancing toward another end edge in the width direction of said blade member are juxtaposed in a blade member feeding direction.

* * * * *